US008714542B2

(12) United States Patent
Tsuji et al.

(10) Patent No.: US 8,714,542 B2
(45) Date of Patent: May 6, 2014

(54) FEEDER AND IMAGE FORMING APPARATUS PROVIDED WITH THE FEEDER

(71) Applicant: Sharp Kabushiki Kaisha, Osaka (JP)

(72) Inventors: Masaru Tsuji, Osaka (JP); Yasuaki Fukada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/661,713

(22) Filed: Oct. 26, 2012

(65) Prior Publication Data

US 2013/0106047 A1 May 2, 2013

(30) Foreign Application Priority Data

Oct. 26, 2011 (JP) ..... 2011-234916
Nov. 17, 2011 (JP) ..... 2011-251818

(51) Int. Cl.
*B65H 3/12* (2006.01)
*B65H 29/70* (2006.01)

(52) U.S. Cl.
USPC ..... 271/94; 271/105; 271/106; 271/188

(58) Field of Classification Search
USPC ..... 271/94, 105, 106, 11, 5, 188, 209, 196, 271/197
See application file for complete search history.

(56) References Cited

U.S. PATENT DOCUMENTS

| | | | | |
|---|---|---|---|---|
| 6,412,769 | B1 * | 7/2002 | Goda et al. | 271/94 |
| 6,595,511 | B2 | 7/2003 | Goda et al. | |
| 7,600,748 | B2 * | 10/2009 | Takai et al. | 271/106 |
| 8,276,905 | B2 * | 10/2012 | Suzuki | 271/98 |
| 2011/0103861 | A1 | 5/2011 | Kakehi | |
| 2011/0140344 | A1 * | 6/2011 | Suzuki | 271/3.22 |

FOREIGN PATENT DOCUMENTS

| | | |
|---|---|---|
| JP | 60-019630 | 1/1985 |
| JP | 4-358637 | 12/1992 |
| JP | 6-107347 | 4/1994 |
| JP | 10-218401 | 8/1998 |
| JP | 11-100139 | 4/1999 |
| JP | 2001-39556 | 2/2001 |
| JP | 2008-179424 | 8/2008 |
| JP | 2011-6176 | 1/2011 |
| WO | WO 2011/052063 A1 | 5/2011 |

* cited by examiner

*Primary Examiner* — David H Bollinger
(74) *Attorney, Agent, or Firm* — Nixon & Vanderhye P.C.

(57) ABSTRACT

Air is taken in through air holes of a paper transfer belt and through air inlets of an air intake duct, and a recording sheet of paper is sucked onto front surfaces of the paper transfer belts, forming the recording sheet of paper into a curved (waved) shape along the front surfaces of the paper transfer belts.

22 Claims, 20 Drawing Sheets

FEEDER AND IMAGE FORMING APPARATUS PROVIDED WITH THE FEEDER

CROSS-REFERENCE TO RELATED APPLICATIONS

The present application claims priority under 35 U.S.C. §119(a) to Japanese Patent Application Nos. 2011-234916, filed Oct. 26, 2011, and 2011-251818, filed Nov. 17, 2011. The contents of these applications are incorporated herein by reference in their entirety.

FIELD OF THE INVENTION

The present invention relates to a feeder that picks up a sheet of paper from a pile of paper stored in a paper storage and forwards the sheet of paper. The present invention also relates to an image forming apparatus provided with the feeder.

CONVENTIONAL ART

An example of this kind of feeder is recited in patent document 1. Here, a plurality of suction transfer belts, arranged in parallel to each other, take in air through suction holes of the suction transfer belts so as to suck a sheet of paper onto the suction transfer belts. Then, the suction transfer belts are turned into circumferential movement so as to transfer the sheet of paper. A guide surface is in sliding contact with the inner circumference surface of each suction transfer belt, and on the guide surface, a plurality of ribs are disposed to protrude downward through the space between the suction transfer belts. The sheet of paper sucked on the suction transfer belts is brought into contact with the ribs to form this sheet of paper into a curved (waved) shape, thereby securing some space between this sheet of paper and the next sheet of paper and separating the sheets of paper from one another. This prevents overlapping feeding of the sheets of paper.

[Patent Document 1] Japanese Unexamined Patent Application Publication No. 4-358637.

SUMMARY OF THE INVENTION

Unfortunately, the practice of forming the sheet of paper into a curved shape by bringing the sheet of paper into contact with the ribs that protrude downward through the space between the suction transfer belts, as recited in patent document 1, involves a gap that occurs between the curved sheet of paper and the suction transfer belts, which are not curved. The gap takes in air through the vicinity of the distal end of the sheet of paper, and the air taken in attracts the next sheet of paper. That is, in the vicinity of the distal end of the sheet of paper, the next sheet of paper is attracted. This has been a cause of overlapping feeding of the sheets of paper.

Additionally, in patent document 1, the ribs protrude to a uniform length, and accordingly, the sheets of paper sucked on the surfaces of the suction transfer belts and brought into contact with the ribs are curved to a uniform degree. Thus, depending on the kind of the paper, the sheet of paper sucked on the surfaces of the suction transfer belts cannot be separated from the next sheet of paper in a satisfactory manner, which has caused overlapping feeding of the sheets of paper. For example, when the paper is thin in thickness, the sheets of paper are highly adhesive with respect to each other. Hence, even though the sheet of paper sucked on the surfaces of the suction transfer belts is curved to form space between this sheet of paper and the next sheet of paper, if this space is too small, the sheets of paper cannot be easily separated from one another, which can cause a tendency toward overlapping feeding of the sheets of paper. The sheets of paper are also highly adhesive with respect to each other when the sheets of paper have high a moisture content, or when the sheets of paper are highly charged. Thus, if the space between the sheet of paper sucked on the surfaces of the suction transfer belts and the next sheet of paper is too small, the sheets of paper cannot be easily separated from each other, which can cause a tendency toward overlapping feeding of the sheets of paper.

The present invention has been made in view of the above-described circumstances, and it is an object of the present invention to provide a feeder that more reliably separates a sheet of paper sucked on the transfer belt from the next sheet of paper, thereby more effectively preventing overlapping feeding of sheets of paper. It is also an object of the present invention to provide an image forming apparatus provided with the feeder.

In order to accomplish the above-described object, a feeder according to the present invention includes a paper storage configured to store a pile of paper and is configured to take in air through an air hole of a paper transfer member so as to suck a sheet of paper among the pile of paper onto a front surface of the paper transfer member and so as to transfer the sheet of paper. The feeder includes a guide unit configured to guide the paper transfer member. The guide unit includes a curved portion smoothly curved in a direction orthogonal to a transfer direction of the sheet of paper. The curved portion is in sliding contact with a rear surface of the paper transfer member opposite the front surface of the paper transfer member.

In this feeder according to the present invention, the rear surface of the paper transfer member is in sliding contact with the curved portion smoothly curved in a direction orthogonal to the transfer direction of the sheet of paper. This makes the front surface of the paper transfer member curved in a similar manner to the manner in which the curved portion is curved, and also makes the sheet of paper sucked on the front surface of the paper transfer member curved in a similar manner to the manner in which the curved portion is curved. This leaves space between the curved sheet of paper sucked on the front surface of the paper transfer member and the non-curved next sheet of paper, and thus separates the sheets of paper from one another, thereby preventing overlapping feeding of the sheets of paper. Additionally, the paper transfer member and the sheet of paper are curved in a similar manner to the manner in which the curved portion is curved. This makes gap difficult to occur between the paper transfer member and the sheet of paper. This, in turn, eliminates air intake into the gap from the vicinity of the distal end of the sheet of paper, and eliminates overlapping feeding of the sheets of paper that would be caused by air intake in the vicinity of the distal end of the sheet of paper.

In the feeder according to the present invention, the paper transfer member may include a plurality of paper transfer members arranged in parallel to each other in a direction orthogonal to the transfer direction of the sheet of paper. The curved portion may include a plurality of curved portions arranged in a direction orthogonal to the transfer direction of the sheet of paper.

Thus, providing a plurality of paper transfer members and a plurality of curved portions makes the front surface of each paper transfer member curved at a plurality of its portions, and also makes the sheet of paper curved at a plurality of its portions. This leaves space at a plurality of positions between the sheet of paper and the next sheet of paper, thereby reliably preventing overlapping feeding of the sheets of paper. Even when the sheet of paper comes in smaller size, the sheet of paper is reliably curved, reliably leaving space between the sheet of paper and the next sheet of paper, thereby preventing overlapping feeding of the sheets of paper.

In the feeder according to the present invention, an arrangement interval between the curved portions may be larger than an arrangement interval between the paper transfer members.

Under this condition, the number of the curved portions is controlled, and one or a plurality of paper transfer members is in sliding contact with a single curved portion, making the front surface of each paper transfer member curved in a satisfactory manner along the curved portion. As a result, the sheet of paper is sucked on the front surface of each paper transfer member in a satisfactory manner.

In the feeder according to the present invention, the curved portions each have a width in the direction orthogonal to the transfer direction of the sheet of paper. The width may be larger in a vicinity of a center of the sheet of paper than in a vicinity of lateral sides of the sheet of paper.

This ensures that the larger width part of the curved portion is formed in the vicinity of the center of the sheet of paper sucked on the front surface of the paper transfer member. This leaves a wide expansion of space between the vicinity of the center of the sheet of paper and the next sheet of paper, and makes the sheets of paper more easily separable, thereby more effectively preventing overlapping feeding of the sheets of paper.

In the feeder according to the present invention, the paper transfer member may include a plurality of paper transfer members in sliding contact with a part of the curved portion having the larger width.

This ensures that even when the curved portion has a large width, the resulting front surface of each paper transfer member is smoothly curved along the curved portion.

In the feeder according to the present invention, the curved portions each have a height from a valley portion to an apex portion. The height may be smaller in a vicinity of lateral sides of the sheet of paper than in a vicinity of a center of the sheet of paper.

This ensures that the curved portion has a larger height at its part in the vicinity of the center of the sheet of paper sucked on the front surface of the paper transfer member. This leaves large space between the vicinity of the center of the sheet of paper and the next sheet of paper and makes the sheets of paper more easily separable, thereby more effectively preventing overlapping feeding of the sheets of paper.

In the feeder according to the present invention, the guide unit may include a rib located between the paper transfer members. The rib may protrude from a gap between the paper transfer members to be flush with a surface of each of the paper transfer members.

Providing such rib ensures that the sucking surface on which to suck the sheet of paper is a smooth alignment of the front surface of each paper transfer member and the end surface of the rib, making the sheet of paper sucked in a more satisfactory manner.

In the feeder according to the present invention, the curved portion may include an air suction inlet overlapping and communicating with a plurality of air holes of the paper transfer member.

This ensures that air is taken in from the air holes of the paper transfer member to the air inlet of the curved portion.

In the feeder according to the present invention, an air suction path may be disposed in a direction orthogonal to the transfer direction of the sheet of paper so as to take in air through the air inlet.

This ensures that air suction path is disposed in a linear form, and ensures a simplified structure of the air suction path.

In the feeder according to the present invention, an air spray may be disposed to spray air onto a front end surface of the pile of paper.

Spraying air onto the front end surface of the pile of paper ensures that air quickly enters the space formed between the curved sheet of paper sucked on the front surface of the paper transfer member and the non-curved next sheet of paper. This makes the sheets of paper more easily separable, thereby more effectively preventing overlapping feeding of the sheets of paper.

In order to accomplish the above-described object, another feeder according to the present invention is configured to take in air through an air hole of a paper transfer belt so as to suck a sheet of paper onto a front surface of the paper transfer belt and so as to transfer the sheet of paper. The feeder includes a curvature setting changer and a controller. The curvature setting changer is configured to curve the front surface of the paper transfer belt in a direction orthogonal to a transfer direction of the sheet of paper, and is configured to change a curvature of the front surface of the paper transfer belt. The controller is configured to control the curvature setting changer.

This feeder according to the present invention controls, by changing, the curvature of the front surface of the paper transfer belt while the front surface of the paper transfer belt is curved in a direction orthogonal to the transfer direction of the sheet of paper, and also controls, by changing, the curvature of the sheet of paper sucked on the front surface of the paper transfer belt. When the sheets of paper are highly adhesive with respect to each other and cannot be easily separated from each other, increasing the curvature of the sheet of paper sucked on the front surface of the paper transfer belt enlarges the space formed between this sheet of paper and the planar next sheet of paper, which is not directly sucked on the front surface of the paper transfer belt. This increases separativeness between the sheets of paper. When, contrarily, the sheets of paper are less adhesive with respect to each other and easily spreadable, lowering the curvature of the sheet of paper sucked on the front surface of the paper transfer belt diminishes the space between this sheet of paper and the next sheet of paper. This ensures that the sheets of paper are reliably separated from each other to be spread, thereby preventing overlapping feeding of the sheets of paper.

In the feeder according to the present invention, the controller may be configured to control the curvature setting changer to change the curvature of the front surface of the paper transfer belt in accordance with at least one of a kind of the sheet of paper, a moisture content of the sheet of paper, and an amount of charging of the sheet of paper.

Depending on the kind of paper, paper varies its thickness, rigidity, basis weight, and the like, and the adhesiveness between the sheets of paper varies, making overlapping feeding of the sheets of paper easier to occur or more difficult to occur. The adhesiveness between the sheets of paper also varies depending on the moisture content and the amount of charging of the paper, making overlapping feeding of the sheets of paper easier to occur or more difficult to occur. In view of this, the curvature of the front surface of the paper transfer belt is changed in accordance with the kind of the sheet of paper, the moisture content of the sheet of paper, and the amount of charging so as to adjust the size of the space formed between the sheet of paper sucked on the front surface of the paper transfer belt and the next sheet of paper. This reliably separates and spreads the sheets of paper from each other in spite of variations in the adhesiveness between the sheets of paper, thereby preventing overlapping feeding of the sheets of paper.

In the feeder according to the present invention, an air inlet portion may be disposed to take in air through the air hole of the paper transfer belt, and the controller may be configured to increase the curvature of the front surface of the paper transfer belt as the sheet of paper becomes thinner in thickness so as to decrease an amount of air intake through the air inlet portion.

As the sheet of paper becomes thinner in thickness, the sheets of paper become highly adhesive with respect to each other, which can cause a tendency toward overlapping feeding of the sheets of paper. In view of this, the curvature of the front surface of the paper transfer belt is increased as the sheet of paper becomes thinner in thickness. This enlarges the space between the sheet of paper sucked on the front surface of the paper transfer belt and the next sheet of paper, thereby increasing the separativeness between the sheets of paper. Additionally, as the sheet of paper becomes thinner in thickness, the sheet of paper becomes more easily sucked onto the front surface of the paper transfer belt. In view of this, the amount of air intake through the air hole of the paper transfer belt is reduced.

In the feeder according to the present invention, the curvature setting changer may include a pressing member configured to press a rear surface of the paper transfer belt so as to curve the front surface of the paper transfer belt in a direction orthogonal to the transfer direction. The controller may be configured to displace the pressing member so as to change a degree by which the pressing member presses the rear surface of the paper transfer belt, thereby changing the curvature of the front surface of the paper transfer belt.

Changing the degree by which the pressing member presses the rear surface of the paper transfer belt ensures changing of the curvature of the front surface of the paper transfer belt.

In the feeder according to the present invention, the pressing member may be configured to press a downstream side portion of the rear surface of the paper transfer belt in a direction in which the sheet of paper is transferred by the paper transfer belt.

The downstream side portion of the rear surface of the paper transfer belt is where the sheet of paper sucked on the front surface of the paper transfer belt is separated from the next sheet of paper and transferred. Hence, separating the sheets of paper from one another at the downstream side portion in a satisfactory manner effectively prevents overlapping feeding of the sheets of paper.

For example, in the feeder according to the present invention, a guide member may be in sliding contact with the rear surface of the paper transfer belt, and the pressing member may be configured to press the rear surface of the paper transfer belt through an opening of the guide member.

In the feeder according to the present invention, the pressing member may be an eccentric cam. The eccentric cam includes a circumference surface on which to press the rear surface of the paper transfer belt. A degree by which the eccentric cam presses the rear surface of the paper transfer belt is changed by a displacement of the circumference surface of the eccentric cam.

In this case, the eccentric cam rotates to displace the part of the circumference surface of the eccentric cam pressing the rear surface of the paper transfer belt, thereby changing the curvature of the front surface of the paper transfer belt.

In the feeder according to the present invention, the controller may be configured to control a rotation angle of the eccentric cam so as to change the degree by which the rear surface of the paper transfer belt is pressed by the eccentric cam, thereby adjusting the curvature of the front surface of the paper transfer belt.

When an eccentric cam is used, the rotation angle of the eccentric cam is controlled to adjust the curvature of the front surface of the paper transfer belt.

In the feeder according to the present invention, the paper transfer belt may include a plurality of paper transfer belts arranged in parallel to each other in a direction orthogonal to the transfer direction of the sheet of paper, and the pressing member may include a plurality of pressing members configured to press rear surfaces of the respective paper transfer belts.

In this case, the curvature of the front surface of each of the paper transfer belts is independently changed. The sheet of paper sucked on the paper transfer belts is curved at a plurality of its portions in a direction orthogonal to the transfer direction of the sheet of paper.

In the feeder according to the present invention, an air suction path of air taken in through the paper transfer belts may be disposed in a direction orthogonal to the transfer direction of the sheet of paper.

This ensures that the air suction path is disposed in a linear form, and ensures a simplified structure of the air suction path.

An image forming apparatus according to the present invention is provided with the above-described feeder according to the present invention.

This image forming apparatus according to the present invention provides advantageous effects similar to those of the feeder according to the present invention.

DESCRIPTION OF THE EMBODIMENTS

Embodiments of the present invention will be described below by referring to the accompanying drawings.

Embodiment 1

Figure 1:
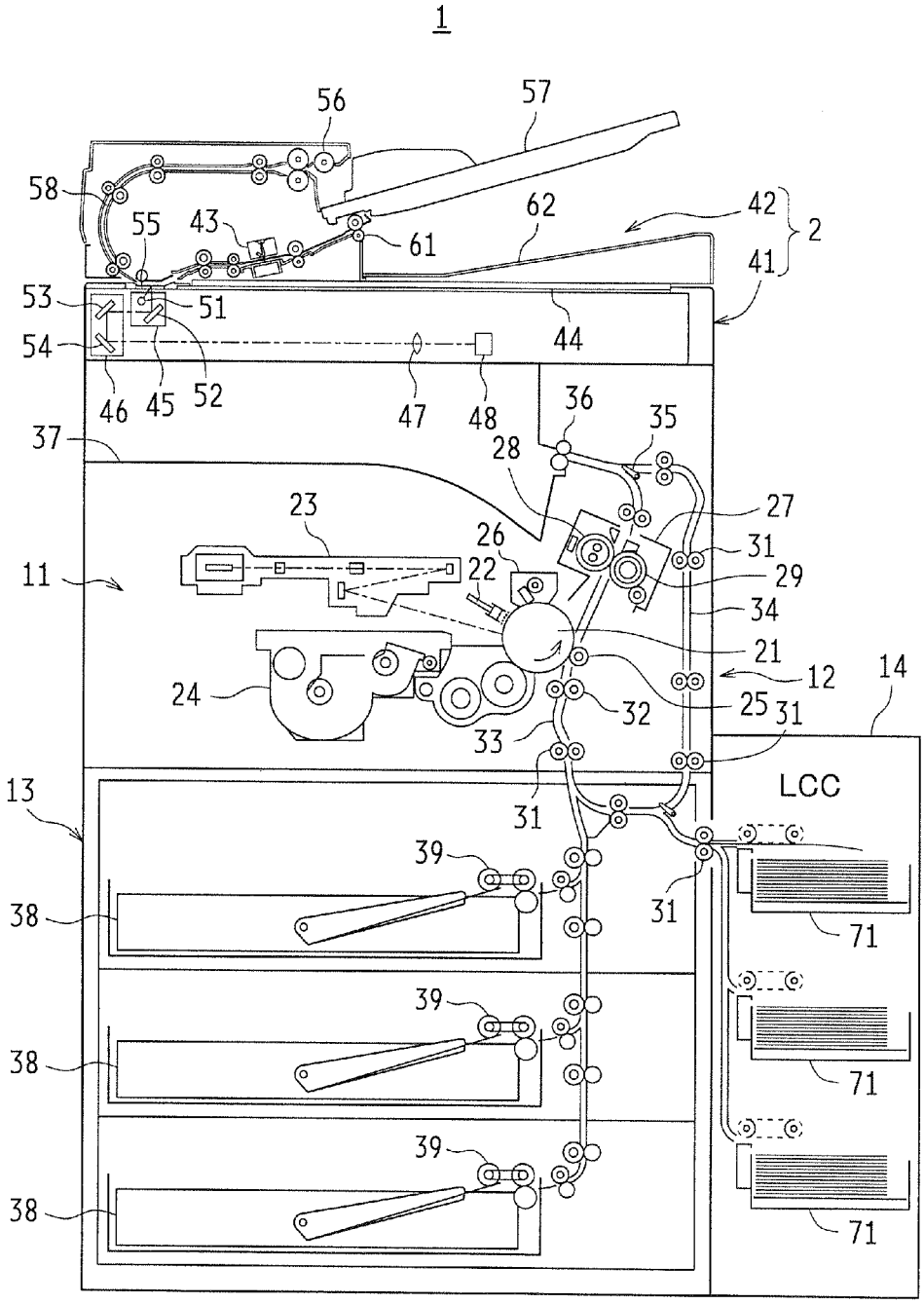
FIG. 1 is a cross-section of an image forming apparatus to which one embodiment of the feeder according to the present invention is applied.

FIG. 1 is a cross-section of an image forming apparatus to which one embodiment of the feeder according to the present invention is applied. To roughly classify the configuration of an image forming apparatus 1, the image forming apparatus 1 includes a document reading unit 2, a printing unit 11, a paper transfer unit 12, a paper supply unit 13, and a large capacity cassette (LCC) 14.

In the printing unit 11, a cleaning device 26 removes and collects residual toner off the surface of the photosensitive drum 21. Then, a charging device 22 charges the surface of the photosensitive drum 21 to a predetermined, uniform potential. A laser exposure device 23 exposes the surface of the photosensitive drum 21 with light to form an electrostatic latent image on the surface. A developing device 24 develops the electrostatic latent image on the surface of the photosensitive drum 21 to form a toner image on the surface of the photosensitive drum 21.

A transfer roller 25 is in pressure contact with the photosensitive drum 21 to define a nip region between the transfer roller 25 and the photosensitive drum 21. A recording sheet of paper transferred through a paper transfer path 33 is held in the nip region while being transferred. Meanwhile, the toner image on the surface of the photosensitive drum 21 is transferred onto the recording sheet of paper. Then, the recording sheet of paper is held between a heating roller 28 and a pressure roller 29 of a fixing device 27, where the recording sheet of paper is heated and pressed, thereby fixing the toner image on the recording sheet of paper.

The paper supply unit 13 includes a plurality of feeding cassettes 38. The feeding cassettes 38 each include a pick-up roller 39 and other elements associated with taking out recording sheets of paper, one at a time, and forwarding the recording sheet of paper. These elements forward the recording sheet of paper to the paper transfer path 33 of the paper transfer unit 12.

The large capacity cassette (LCC) 14 is capable of accommodating the recording sheets of paper in large quantities, and picks up one recording sheet of paper at a time and forwards the recording sheet of paper to the paper transfer path 33 of the paper transfer unit 12.

This recording sheet of paper is transferred past the transfer roller 25 and the fixing device 27 through the paper transfer path 33, and discharged onto a paper discharge tray 37 through paper discharge rollers 36. Along the paper transfer path 33, some rollers are disposed including registration rollers 32, transfer rollers 31, and the paper discharge rollers 36. The registration rollers 32 temporarily stop the recording sheet of paper to put the distal end of the recording sheet of paper in order, and resumes transfer of the recording sheet of paper at the transfer timing at which the toner image is transferred between the photosensitive drum 21 and the transfer roller 25 at the nip region. The transfer rollers 31 promote transfer of the recording sheet of paper.

When text is printed both on the front surface and rear surface of the recording sheet of paper, the position of a branching claw 35 is switched to transfer the recording sheet of paper in an inverse direction, from the paper discharge rollers 36 to the reverse path 34, thereby turning the recording sheet of paper upside down, and the recording sheet of paper is again guided to the registration rollers 32. Then, an image is recorded on and fixed to the rear surface of 12 the recording sheet of paper in a similar manner to the manner associated with the front surface of the recording sheet of paper, and the recording sheet of paper is discharged onto the paper discharge tray 37.

Next, the document reading unit 2 disposed at an upper portion of the main body of the image forming apparatus 1 will be described. In the document reading unit 2, a document transfer section 42 has its base side pivotally supported by a base side of a first reading section 41 through a hinge (not shown). The document transfer section 42 moves its front portion upward and downward so as to open the document transfer section 42 itself so that a document sheet of paper can be placed on a platen glass 44 of the first reading section 41.

In the first reading section 41, a first scan unit 45 moves in a vertical scanning direction and at the same time illuminates the front surface of the document sheet of paper on the platen glass 44 using a light source 51. Then, the first scan unit 45 reflects the reflection light from the document sheet of paper at a first reflection mirror 52 to guide the light to a second scan unit 46. The second scan unit 46 moves following the first scan unit 45 and at the same time reflects the reflection light from the document sheet of paper at second and third reflection mirrors 53 and 54. This reflection light is concentrated to a CCD 48 (Charge Coupled Device) through an imaging lens 47, and the CCD 48 reads the image on the document sheet of paper.

To read the image on the front surface of the document sheet of paper that is being transferred by the document transfer section 42, the first scan unit 45 moves to a reading position under a document reading glass 55, as shown in FIG. 1, and the position of the second scan unit 46 is determined in accordance with the position of the first scan unit 45. In this state, a pick-up roller 56 picks up the document sheet of paper on a document tray 57 and transfers the document sheet of paper through a document transfer path 58. Then, the light source 51 of the first scan unit 45 illuminates the front surface of the document sheet of paper through the document reading glass 55, and the reflection light from the document sheet of paper is guided to the imaging lens 47 by reflection mirrors of the first and second scan units 45 and 46. Then, the CCD 48 reads the image on the document sheet of paper, and the document sheet of paper is discharged from document discharge rollers 61 onto a document discharge tray 62.

Then, a second reading section 43 (Contact Image Sensor (CIS)), which is disposed in the document transfer section 42, illuminates the rear surface of the document sheet of paper when it is passed under the second reading section (CIS) 43 to be discharged onto the document discharge tray 62. The second reading section (CIS) 43 then receives the reflection light from the rear surface of the document sheet of paper to read the image on the rear surface of the document sheet of paper.

The images on the document sheet of paper read by the CCD 48 and the CIS 43 in the above-described manner are input to the laser exposure device 23 of the image forming apparatus 1, and the image forming apparatus 1 records the images onto a recording sheet of paper. This recording sheet of paper is output as a copy document.

Next, description will be made in detail with regard to a configuration of a feeder 71 according to this embodiment, which is disposed in the large capacity cassette 14. The feeder 71 stores and accommodates therein recording sheets of paper in large quantities, and picks up one recording sheet of paper at a time and forwards the recording sheet of paper to the transfer path 33 (which is shown in FIG. 1).

Figure 2:
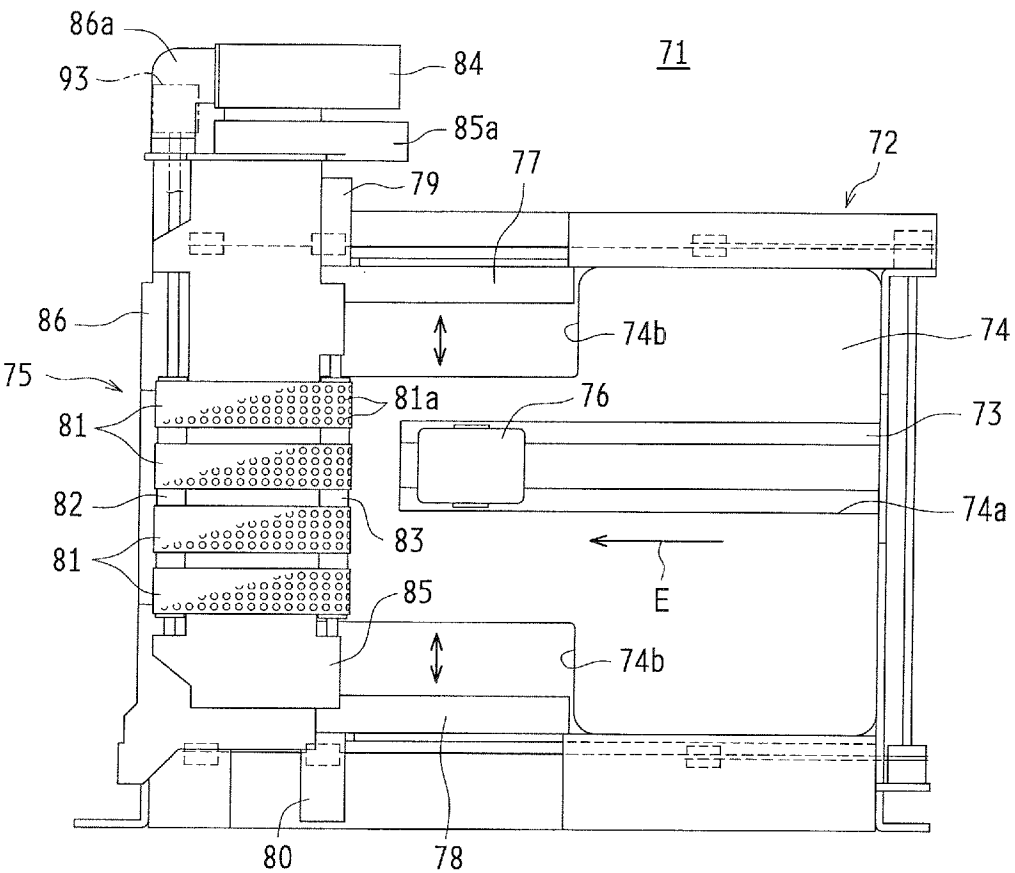
FIG. 2 is a plan view of a feeder according to this embodiment.
Figure 3:
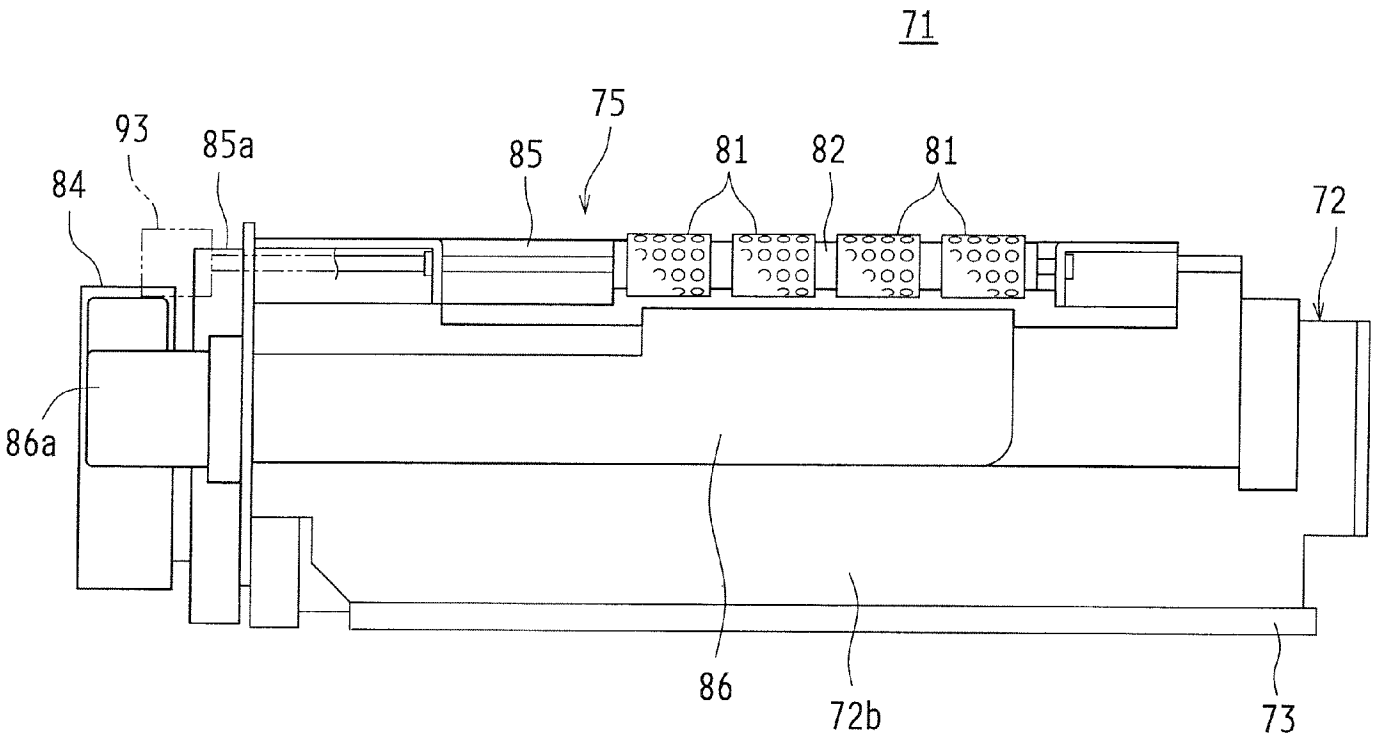
FIG. 3 is a front view of the feeder.

FIGS. 2 and 3 are respectively a plan view and a front view of the feeder 71 according to this embodiment. As shown in FIGS. 2 and 3, the feeder 71 includes an outer frame 72, a bottom plate 73, a paper storage 74 disposed on the inner side of the outer frame 72, and a paper drawer 75 disposed above an end of the outer frame 72.

The paper storage 74 stores recording sheets of paper in large quantities (a pile of paper), and is liftably disposed on the inner side of the outer frame 72. The paper storage 74 has an opening 74*a* elongated in a pick-up direction (paper transfer direction) E of the recording sheet of paper. A paper rear end guide 76 is supported on the bottom plate 73 and is capable of reciprocating movement along the pick-up direction E of the recording sheet of paper on the bottom plate 73. The paper rear end guide 76 protrudes upward through the opening 74*a* of the paper storage 74. The pick-up direction (paper transfer direction) E of the recording sheet of paper will be assumed frontward, while the direction opposite the pick-up direction E will be assumed rearward.

On both lateral sides of the paper storage 74, depressions 74*b* are formed. The depressions 74*b* respectively contain assist ducts 77 and 78. The assist ducts 77 and 78 are supported on both lateral sides of the outer frame 72 and capable of reciprocating movement in a direction orthogonal to the pick-up direction E. Specifically, the assist ducts 77 and 78 move in tandem to one another so as to approach one another or move away from one another.

The paper drawer 75 includes four seamless paper transfer belts 81, a pair of rollers 82 and 83 around which the paper transfer belts 81 are looped, an air intake-exhaust fan 84, an air intake duct 85, and an air exhaust duct 86. The paper transfer belts 81 each have multiple air holes 81*a*, and air is taken in from the air holes 81*a* of the paper transfer belts 81 and passed through the air intake duct 85 into the air intake-exhaust fan 84. The air exhausted from the air intake-exhaust fan 84 is guided through the air exhaust duct 86, and blown from the air exhaust duct 86 to the inner side of the outer frame 72 in the direction opposite the pick-up direction E (rearward).

Figure 4:
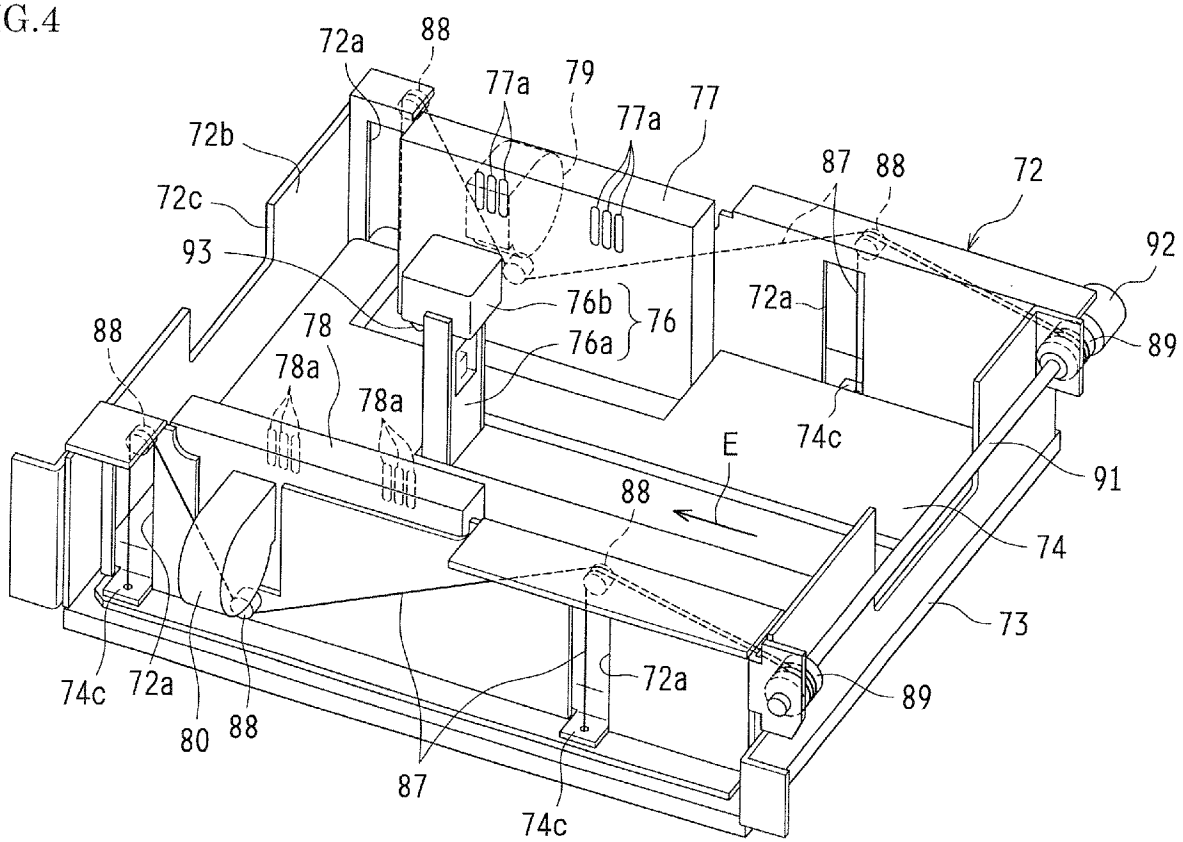
FIG. 4 is a rear perspective view of the feeder with a paper drawer removed.

FIG. 4 is a rear perspective view of the outer frame 72, the bottom plate 73, the paper storage 74, and other elements with the paper drawer 75 removed. As shown in FIG. 4, on the outer sides of the assist ducts 77 and 78, the assist fans 79 and 80 are respectively disposed. The assist ducts 77 and 78 each have a hollow structure in which a ventilation path passes through the hollow. When the assist fans 79 and 80 taken in air, the air is forwarded to the ventilation paths of the assist ducts 77 and 78 and blown to the inner side of the outer frame 72 through air outlets 77*a* and 78*a* respectively of the assist ducts 77 and 78.

As shown in FIGS. 2 and 4, the paper rear end guide 76 is capable of reciprocating movement along the pick-up direction E of the recording sheet of paper, and is positioned at a desired point in the pick-up direction E. Also as shown in FIGS. 2 and 4, the assist ducts 77 and 78 are capable of reciprocating movement in a direction orthogonal to the pick-up direction E, and are positioned at desired points in the direction orthogonal to the pick-up direction E.

When a pile of paper is stored in the paper storage 74, the paper rear end guide 76 is moved rearward to ensure ample space between the paper rear end guide 76 and a contact plate 72*b* of the outer frame 72. Meanwhile, the assist ducts 77 and 78 are moved in directions to be spaced away from one another to ensure ample space between the assist ducts 77 and 78. In this state, a pile of paper is placed in the paper storage 74, and then the paper rear end guide 76 is moved in the pick-up direction E to have a column 76*a* of the paper rear end guide 76 push the rear end of the pile of paper in the pick-up direction E. This moves the pile of paper by sliding on the paper storage 74 and brings the front end of the pile of paper into contact with the contact plate 72*b* of the outer frame 72. The position of the pile of paper is determined with the front end and the rear end of the pile of paper held at the column 76*a* of the paper rear end guide 76 and the contact plate 72*b* of the outer frame 72. Meanwhile, the assist ducts 77 and 78 are moved in directions to approach one another to determine the position of the pile of paper with both lateral sides of the pile of paper held at the assist ducts 77 and 78.

As shown in FIG. 4, two protruding pieces 74*c* are disposed on both lateral sides of the paper storage 74. The protruding pieces 74*c* protrude from openings 72*a* disposed on both lateral sides of the outer frame 72. On one lateral side of the outer frame 72, two wires 87 are coupled to the protruding pieces 74*c* on one lateral side of the paper storage 74. The wires 87 are routed while being wound around a plurality of idler pulleys 88 and coupled to the winder pulley 89. On the other lateral side of the outer frame 72, other two wires 87 are coupled to the protruding pieces 74*c* on the other lateral side of the paper storage 74. The other wires 87 are routed while being wound around a plurality of other idler pulleys 88 and coupled to another winder pulley 89. The winder pulleys 89 are secured to both ends of a rotatably supported common shaft 91, and a pulse motor 92 drivingly rotates the shaft 91 to turn the winder pulleys 89 into rotation and make the wires 87 wound up around the winder pulleys 89 or drawn from the winder pulleys 89.

When the pulse motor 92 drivingly rotates the shaft 91 to turn the winder pulleys 89 into clockwise rotation, the wires 87 are wound up around the winder pulleys 89, thereby lifting the paper storage 74 upward. When the winder pulleys 89 are turned into counter-clockwise rotation, the wires 87 are drawn from the winder pulleys 89, thereby lifting the paper storage 74 downward. The rotation angle of the winder pulleys 89 as drivingly rotated by the pulse motor 92 is in a corresponding relationship with the height of the paper storage 74. Hence, controlling the rotation direction and rotation angle of the pulse motor 92 ensures adjustment of the height of the paper storage 74.

Figure 5:
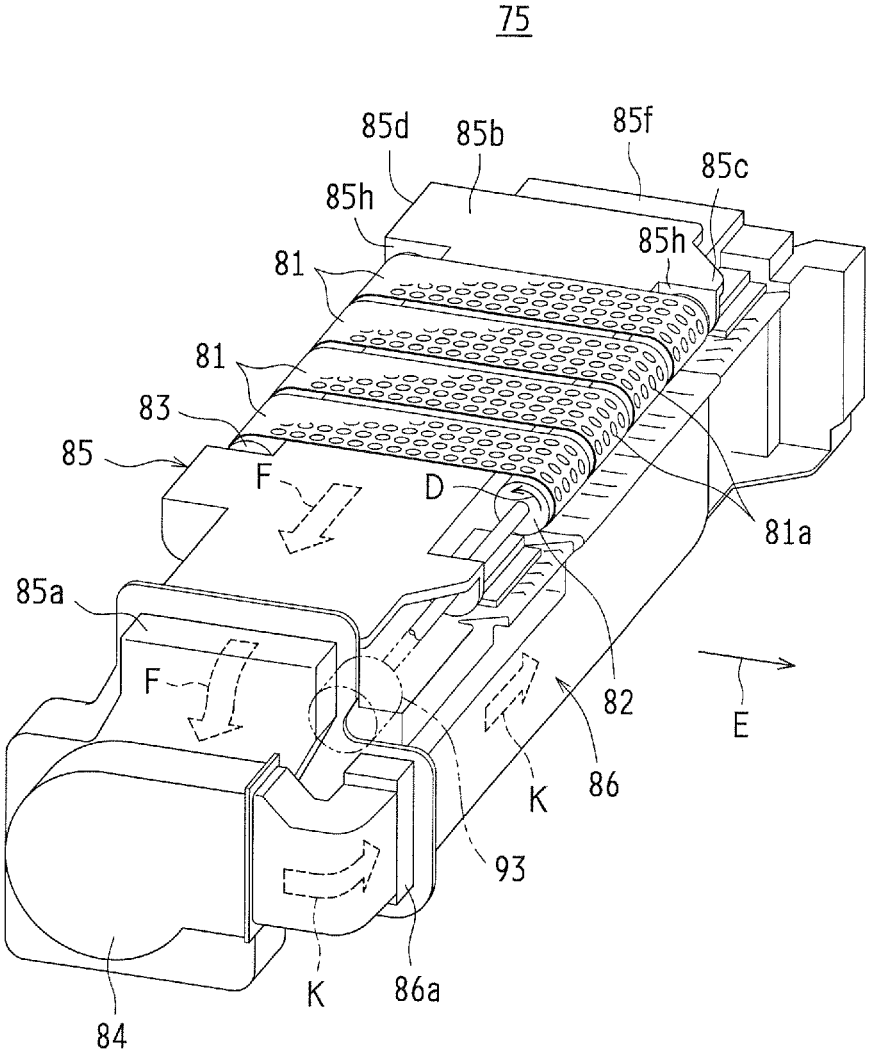
FIG. 5 is an upper perspective view of the paper drawer of the feeder.
Figure 6:
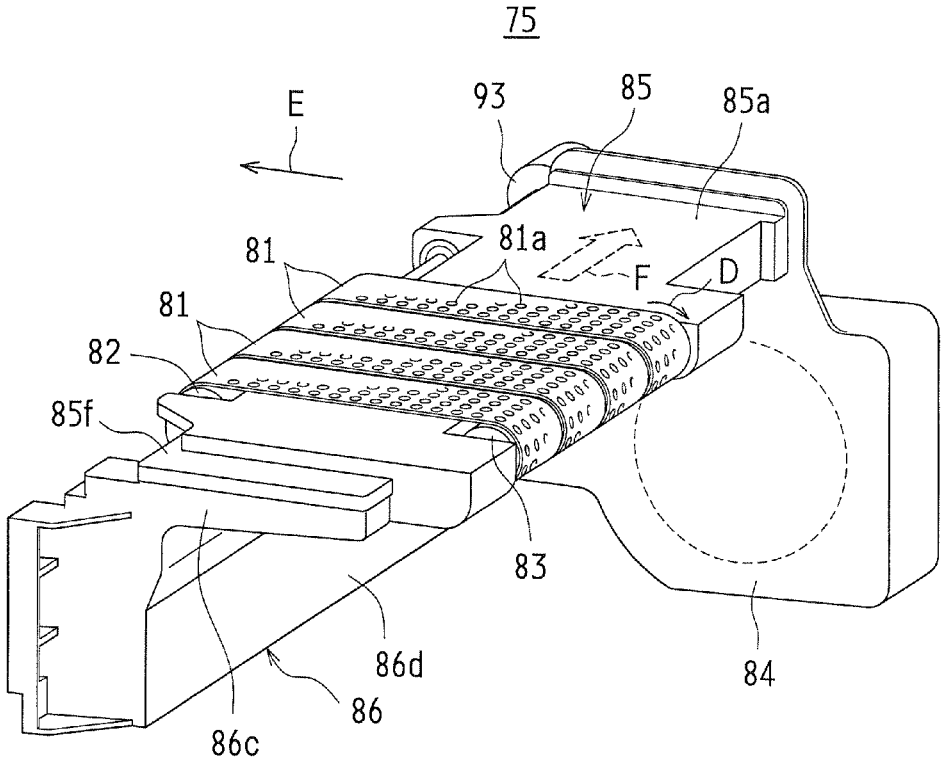
FIG. 6 is an upper rear perspective view of the paper drawer.
Figure 7:
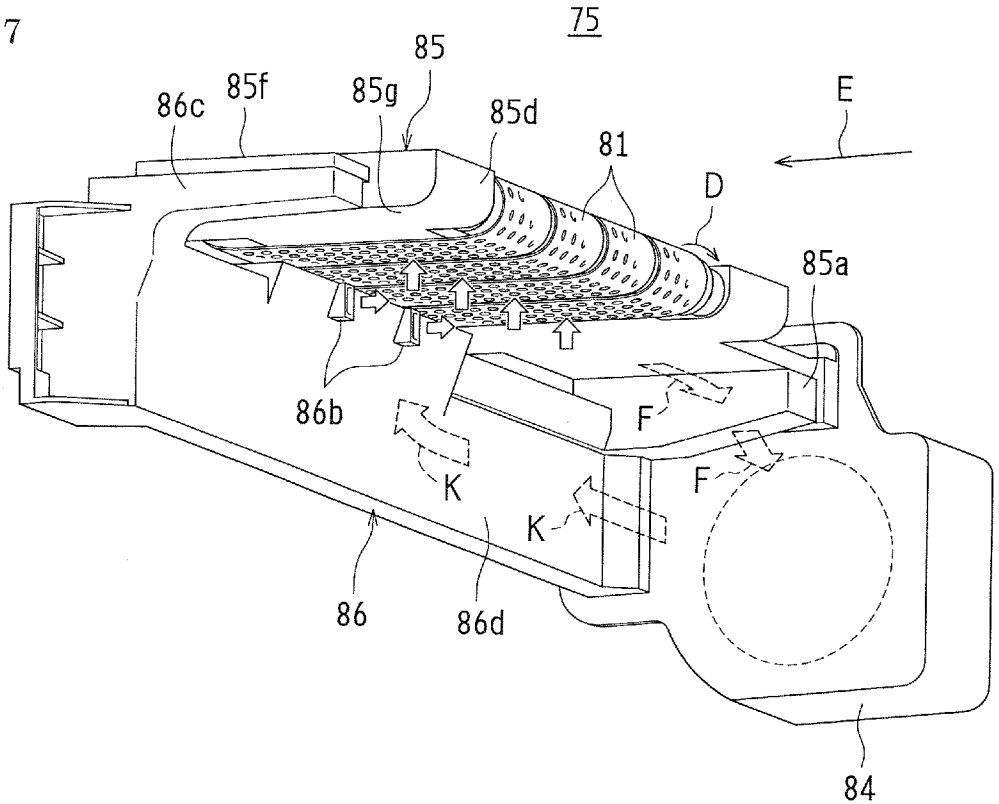
FIG. 7 is a lower rear perspective view of the paper drawer.

Next, a configuration of the paper drawer 75 will be described in detail. FIG. 5 is an upper perspective view of the paper drawer 75. FIG. 6 is an upper rear perspective view of the paper drawer 75. FIG. 7 is a lower rear perspective view of the paper drawer 75.

As shown in FIGS. 5, 6, and 7, the paper drawer 75 includes the four seamless paper transfer belts 81, the pair of rollers 82 and 83 around which the paper transfer belts 81 are looped, the air intake-exhaust fan 84, the air intake duct 85, and the air exhaust duct 86.

The air intake duct 85 has a hollow structure in which an air suction path extends through the hollow in a direction orthogonal to the pick-up direction (paper transfer direction) E. The air intake duct 85 has one lateral side 85*a* coupled to the air intake-exhaust fan 84 so that air passes through the air suction path of the air intake duct 85 and the one lateral side 85*a* to be taken into the air inlet port (not shown) of the air intake-exhaust fan 84, as indicated by the arrow F.

The air intake duct 85 also has a front end 85*c* and a rear end 85*d* each provided with a depression 85*h*. The depressions 85*h* receive and rotatably support the rollers 82 and 83. The frontward roller 82 has its axis coupled to the output shaft of a transfer motor 93. The paper transfer belts 81 are looped around the rollers 82 and 83 while being slightly spaced apart from an upper surface 85*b* of the air intake duct 85 and being in contact with a lower surface 85*g* of the air intake duct 85.

Figure 9:
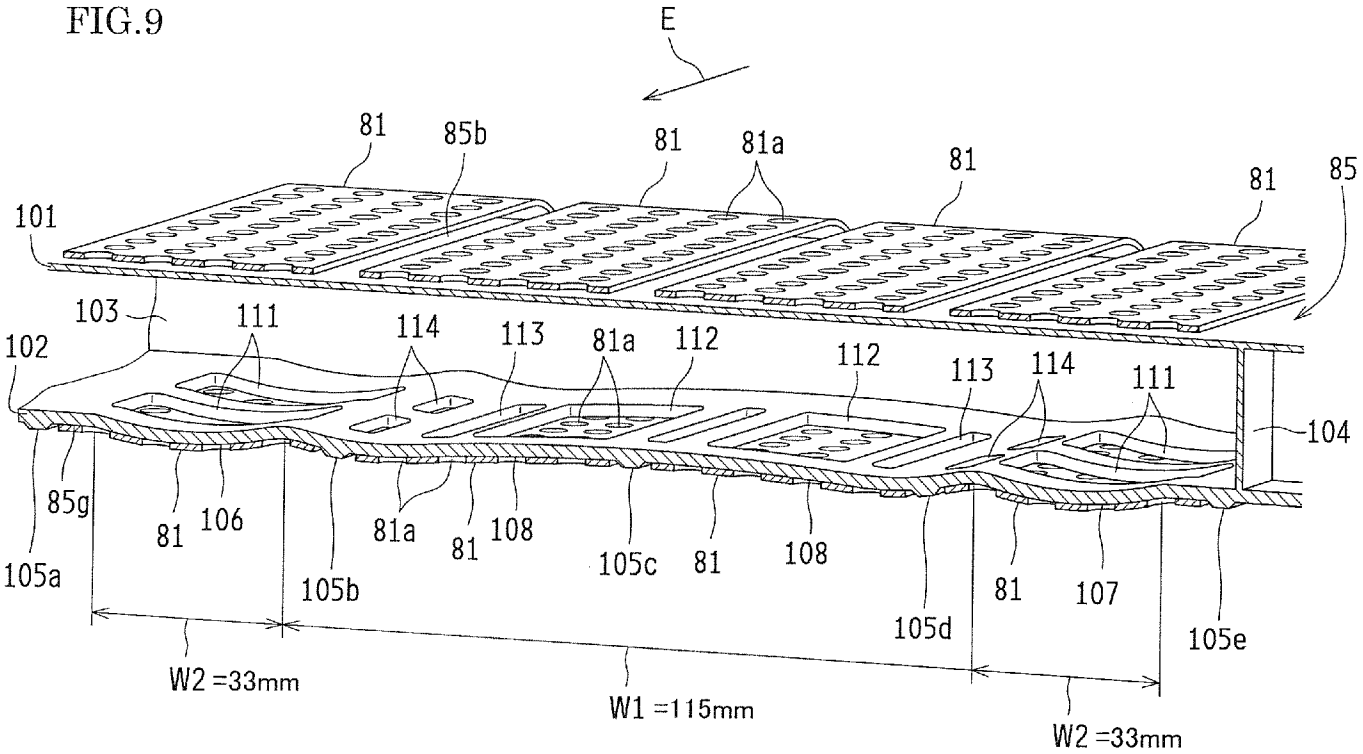
FIG. 9 is a perspective view of a cross-section, in a direction orthogonal to a pick-up direction of a recording sheet of paper, of the feeder with an air intake duct and paper transfer belts.
Figure 10:
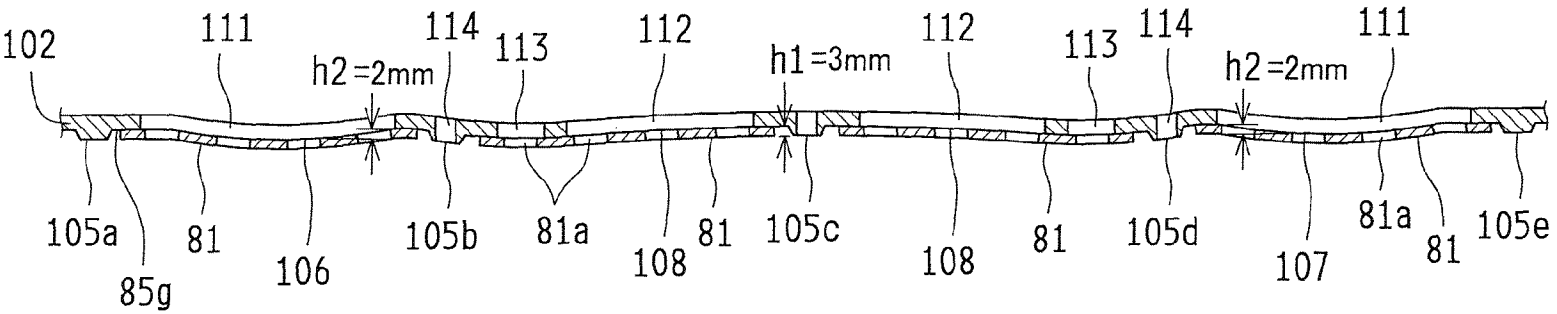
FIG. 10 is a cross-section, in a direction orthogonal to the pick-up direction of the recording sheet of paper, of a guide bottom plate of the air intake duct and the paper transfer belts.

On the lower surface 85*g* of the air intake duct 85, air suction inlets (which are shown in FIGS. 9 and 10) are disposed for each of the paper transfer belts 81. The air suction inlets overlap with the plurality of air holes 81*a* of each paper transfer belt 81.

Here, the transfer motor 93 drivingly rotates the frontward roller 82 in the arrow D direction, and the rearward roller 83 is rotated following the rotation of the frontward roller 82, turning the paper transfer belts 81 into circumferential movement in the arrow D direction. The air intake-exhaust fan 84 takes in the air contained in the air intake duct 85, and the air flows into the air suction inlets on the lower surface 85*g* of the air intake duct 85 and into the air holes 81*a* of the paper transfer belts 81. This makes the recording sheet of paper sucked onto the front surfaces of the paper transfer belts 81, and the paper transfer belts 81 transfer the recording sheet of paper.

The air exhaust duct 86 also has a hollow structure in which a ventilation path extends in a direction orthogonal to the pick-up direction E. The air exhaust duct 86 has one lateral side 86*a* coupled to the air intake-exhaust fan 84 so that air is forwarded to the ventilation path of the air exhaust duct 86 from the air exhaust port (not shown) of the air intake-exhaust fan 84 through the one lateral side 86*a* of the air exhaust duct 86, as indicated by the arrow K.

The air exhaust duct 86 has an inner wall 86*d* on which air exhaust ports 86*b* communicate with the ventilation path of the air exhaust duct 86. The inner wall 86*d* of the air exhaust duct 86 abuts on the outer side surface of the contact plate 72*b* of the outer frame 72 (which is shown in FIG. 4). The air exhaust ports 86*b* of the air exhaust duct 86 face the inner side of the outer frame 72 through a cutout 72*c* on the contact plate 72*b* of the outer frame 72. When the air is forwarded from the air intake-exhaust fan 84 to the air exhaust duct 86, the air is then blown from the air exhaust ports 86*b* in the rearward direction on the inner side of the outer frame 72.

The one lateral side 85*a* of the air intake duct 85 and the one lateral side 86*a* of the air exhaust duct 86 are together coupled to the air intake-exhaust fan 84. Another lateral side 85*f* of the air intake duct 85 and another lateral side 86*c* of the air exhaust duct 86 are coupled to one another. Thus, the air intake-exhaust fan 84, the air intake duct 85, and the air exhaust duct 86 are integral with each other.

Figure 8:
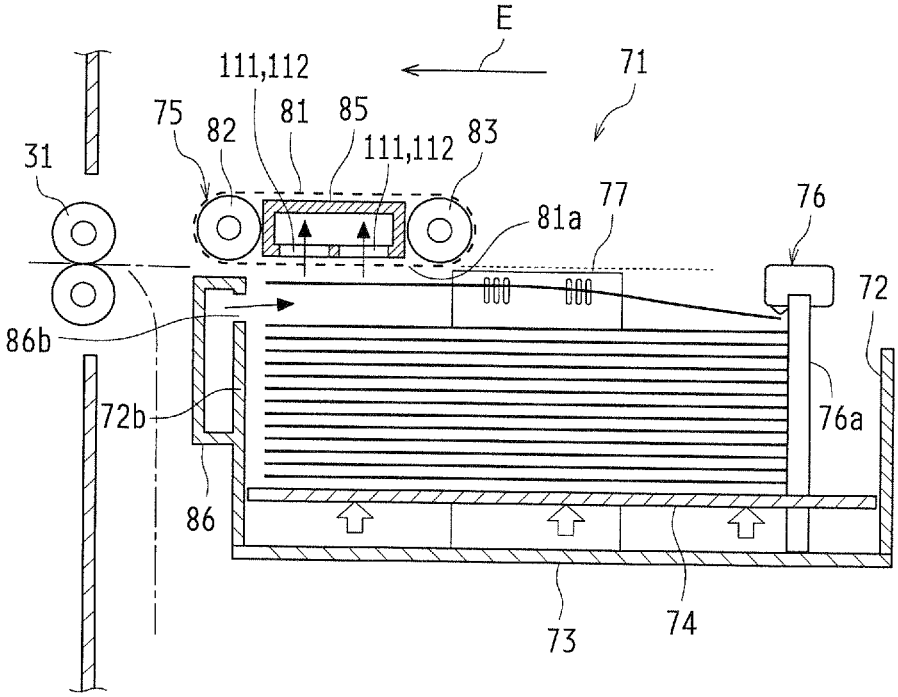
FIG. 8 is a schematic cross-section of the feeder.

In the feeder 71 thus configured, a pile of paper is placed in the paper storage 74, and the position of the pile of paper is determined between the column 76*a* of the paper rear end guide 76 and the contact plate 72*b* of the outer frame 72, and the position of the pile of paper is also determined between the assist ducts 77 and 78, as shown in FIG. 8, which is a schematic cross-section. Then, the pulse motor 92 turns the winder pulleys 89 into clockwise rotation to lift the paper storage 74 upward, thereby positioning the uppermost recording sheet of paper among the pile of paper at a predetermined height. Then, air is forwarded from the assist fans 79 and 80 to the assist ducts 77 and 78 and passed through the air outlets 77*a* and 78*a* respectively of the assist ducts 77 and 78. The air is then blown to the pile of paper on the paper storage 74, specifically to part of the upper layers of the pile of paper that is near the front end of the pile of paper and is on both lateral side surfaces of the pile of paper. Thus, the air enters between the recordings sheet of paper, thereby spreading the recording sheets of paper. Additionally, air is forwarded from the air intake-exhaust fan 84 to the air exhaust duct 86 and passed through air exhaust holes 86*b* of the air exhaust duct 86. The air is then blown to another part of the upper layers of the pile of paper that is on the front end surface of the pile of paper. Thus, the air enters between the recordings sheet of paper, thereby spreading the recording sheets of paper. This lowers the adhesive force between the upper-layer recording sheets of paper among the pile of paper, and facilitates picking up of a recording sheet of paper from the pile of paper. This, as a result, facilitates picking up of one recording sheet of paper at a time.

In this state, air is taken in from the air intake duct 85 to the air intake-exhaust fan 84 so as to make the air taken in through the air holes 81*a* of the paper transfer belts 81 and through the air suction inlets 111 and 112 on the lower surface 85*g* of the air intake duct 85. This makes the recording sheet of paper sucked and attached to the front surfaces of the paper transfer belts 81. Simultaneously, the transfer motor 93 rotates the rollers 82 and 83 to turn the paper transfer belts 81 into circumferential movement. Thus, the paper transfer belts 81 pick up the recording sheet of paper in the pick-up direction E to transfer the recording sheet of paper to the pair of transfer rollers 31 of the image forming apparatus 1, and the recording sheet of paper is transferred through the transfer path 33. When the recording sheet of paper is transferred to the pair of rollers 31, the air intake-exhaust fan 84 temporarily stops its air intake, and the transfer motor 93 temporarily stops its rotation of the rollers 82 and 83. After completion of picking up of the recording sheet of paper from the paper transfer belts 81, the air intake-exhaust fan 84 resumes its air intake, and the transfer motor 93 resumes its rotation of the rollers 82 and 83, so that a next recording sheet of paper is sucked onto the front surfaces of the paper transfer belts 81. The paper transfer belts 81 pick up the next recording sheet of paper in the pick-up direction E and transfer the next recording sheet of paper to the pair of transfer rollers 31. This procedure is repeated so that recording sheets of paper are sucked onto the front surfaces of the paper transfer belts 81, and the paper transfer belts 81 pick up the recording sheets of paper in the pick-up direction E.

Incidentally, in the feeder 71, the recording sheets of paper are spread by blowing air to the lateral side surfaces and the front end surface of the pile of paper from the air outlets 77*a* and 78*a* respectively of the assist ducts 77 and 78 and from the air exhaust holes 86*b* of the air exhaust duct 86. Occasionally, however, the front surfaces of the paper transfer belts 81 pick up a plurality of overlapping recording sheets of paper. Leaving this phenomenon unattended can cause overlapping feeding of the recording sheets of paper.

In view of this, in this embodiment, the front surfaces of the paper transfer belts 81 are curved (waved) in a direction orthogonal to the pick-up direction (paper transfer direction) E of the recording sheet of paper. Accordingly, the recording sheet of paper sucked on the front surfaces of the paper transfer belts 81 is curved. This leaves space between the recording sheet of paper curved by being sucked on the front surfaces of the paper transfer belts 81 and the non-curved next recording sheet of paper not directly sucked on the surfaces, thereby separating the recording sheets of paper from one another. This prevents overlapping feeding of the recording sheets of paper.

The paper transfer belts 81 and the recording sheet of paper sucked on the front surfaces of the paper transfer belts 81 is curved in a mutually similar manner, and this eliminates the possibility of gap between the front surfaces and the recording sheet of paper. This, in turn, eliminates air intake into the gap from the vicinity of the distal end of the recording sheet of paper, and eliminates overlapping feeding of the recording sheets of paper that would be caused by air intake in the vicinity of the distal end of the recording sheet of paper.

Next, description will be made in detail with regard to a configuration of curving the front surfaces of the paper transfer belts 81 in a direction orthogonal to the pick-up direction (paper transfer direction) E of the recording sheet of paper.

FIG. 9 is a perspective view of a cross-section, in a direction orthogonal to the pick-up direction E of the recording sheet of paper, of the air intake duct 85 and the paper transfer belts 81. FIG. 10 is a cross-section, in the same direction as in FIG. 9, of the guide bottom plate 102 of the air intake duct 85 and the paper transfer belts 81.

As shown in FIGS. 9 and 10, between a top plate 101 and the guide bottom plate 102 of the air intake duct 85, an air suction path 103 extends in a direction orthogonal to the pick-up direction E, and the air suction path 103 is sealed at its end by a partition wall 104. The paper transfer belts 81 are slightly spaced apart from the upper surface 85*b* of the top plate 101 and in contact with the lower surface 85*g* of the guide bottom plate 102.

On the lower surface 85*g* of the guide bottom plate 102, five ribs 105*a* to 105*e* extend in the pick-up direction E and protrude downward. Each of the intervals between the ribs 105*a* to 105*e* approximately corresponds to the width of each paper transfer belt 81. The paper transfer belts 81 are held between the ribs 105*a* to 105*e*.

Between the rib 105*a* and the rib 105*b* on one end side, the lower surface 85*g* of the guide bottom plate 102 forms a smooth curved surface 106 that somewhat protrudes downward. Likewise, between the rib 105*e* and the rib 105*d* on the other end side, the lower surface 85*g* of the guide bottom plate 102 forms a smooth curved surface 107 that somewhat protrudes downward. Although the curved surfaces 106 and 107 are flat or slightly depressed in the vicinity of both end sides of each curved surface, the curved surfaces 106 and 107 as a whole can be considered somewhat protruding downward.

In the range between the three center ribs 105*b*, 105*c*, and 105*d*, the lower surface 85*g* of the guide bottom plate 102 forms a smooth curved surface 108 that is depressed upward.

The paper transfer belts 81 have some elasticity, and when looped across the rollers 82 and 83, the paper transfer belts 81 is in pressure contact with the lower surface 85*g* of the air intake duct 85 (the curved surfaces 106, 107, and 108). Thus, the paper transfer belts 81 are deformed along the curved surfaces 106, 107, and 108, and the front surfaces of the paper transfer belts 81 are curved along the curved surfaces 106, 107, and 108.

On the side curved surfaces 106 and 107, a plurality of air suction inlets 111 are formed, while on the center curved surfaces 108, a plurality of air suction inlets 112 and 113 are formed. The region where each of the air suction inlets 111, 112, and 113 is formed is set at a width smaller than the width of each paper transfer belt 81, and the paper transfer belts 81 cover the air suction inlets 111, 112, and 113. All of the air suction inlets 111, 112, and 113 overlap with the plurality of air holes 81*a* of the paper transfer belts 81. This ensures that while the paper transfer belts 81 are making circumferential movement, air passes through the air holes 81*a* of the paper transfer belts 81 and the air suction inlets 111, 112, and 113, and is taken into the air suction path 103 of the air intake duct 85.

It should be noted that not only the curved surfaces 106 to 108, but also the ribs 105*b*, 105*c*, and 105*d* are provided with air suction inlets, namely air suction inlets 114, which are smaller in size.

Figure 11:
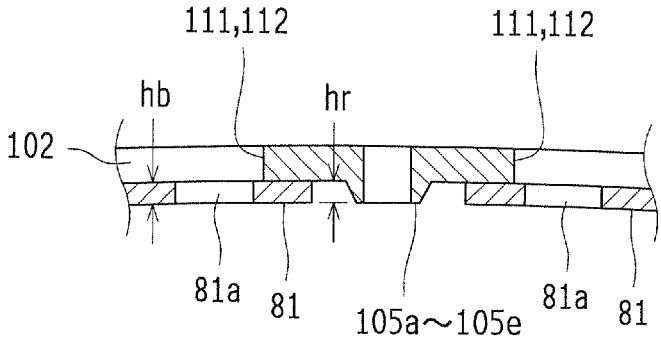
FIG. 11 is an enlarged cross-section of a rib and the paper transfer belts shown in FIG. 10.

The height hr of each of the ribs 105*a* to 105*e* is approximately equal to the thickness hb of each paper transfer belt 81, as shown in enlarged view in FIG. 11. The downward end surfaces of the ribs 105*a* to 105*e* are flush with the front surfaces of the paper transfer belts 81. Thus, the end surfaces of the ribs 105*a* to 105*e* and the front surfaces of the paper transfer belts 81 are aligned to form a smooth curved surface.

As shown in FIG. 9, the side curved surfaces 106 and 107 each have a width w2 (=33 mm) in a direction orthogonal to the pick-up direction E. The width w2 is slightly smaller than the width of each paper transfer belt 81. The curved surfaces 106 and 107 are each in sliding contact with a single paper transfer belt 81. The center curved surfaces 108 have a width w1 (=115 mm) in the direction orthogonal to the pick-up direction E. The width w1 is larger than twice the width of each paper transfer belt 81. The curved surfaces 108 are in sliding contact with two paper transfer belts 81. In other words, the curved surfaces 106 to 108 are arranged at average intervals (pitch) larger than the intervals (pitch) at which the paper transfer belts 81 are arranged. This minimizes the number of the curved surfaces 106 to 108 so that one or a plurality of paper transfer belts 81 is in sliding contact with a single curved surface.

As shown in FIG. 10, the side curved surfaces 106 and 107 each have a height h2 (=2 mm) from their valley portion to apex portion. The height h2 (=2 mm) is smaller than a height h1 (=3 mm) of each of the center curved surfaces 108 from their valley portion to apex portion. This keeps the curvature of the side curved surfaces 106 and 107 to a low level, which in turn ensures that even a single paper transfer belt 81 is curved in a satisfactory manner along the curved surfaces 106 and 108. Since two paper transfer belts 81 are in sliding contact with the center curved surfaces 108, the front surfaces of the paper transfer belts 81 are smoothly curved along the center curved surfaces 108. As a result, all of the front surfaces of the paper transfer belts 81 are curved in a satisfactory manner along the curved surfaces, and this facilitates sucking of the recording sheet of paper onto the front surfaces of the paper transfer belts 81.

Figure 12:
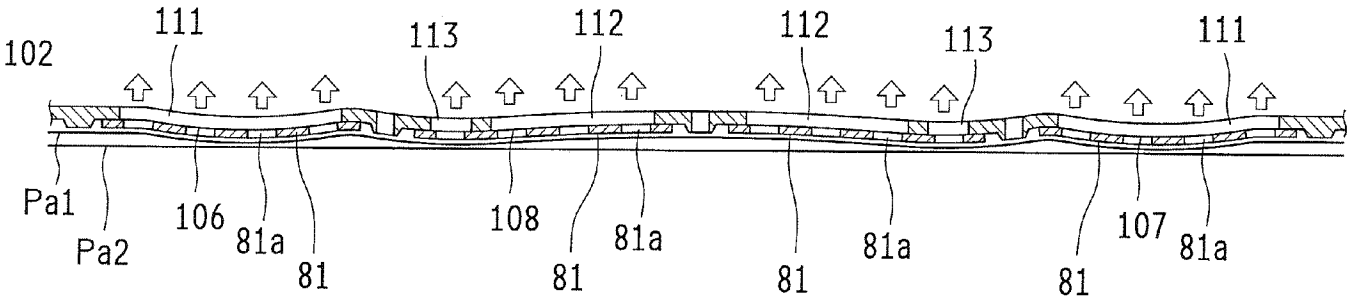
FIG. 12 is a schematic cross-section of the guide bottom plate of the air intake duct and the paper transfer belts shown in FIG. 10 and the recording sheet of paper.

In this configuration, as shown in cross-section in FIG. 12, air is taken in from the air intake duct 85 to the air intake-exhaust fan 84, and the air is then taken in through the air holes 81*a* of the paper transfer belts 81, through the air suction inlets 111, 112, and 113 of the air intake duct 85, and through the air suction inlets 114 of the ribs. This makes the recording sheet of paper Pa1 sucked onto the front surfaces of the paper transfer belts 81, and makes the recording sheet of paper Pa1 curved (waved) along the front surfaces of the paper transfer belts 81. Thus, even when a plurality of overlapping recording sheets of paper Pa1 and Pa2 are attracted to the front surfaces of the paper transfer belts 81, space is left between the uppermost recording sheet of paper Pa1 curved by being directly sucked on the front surfaces of the paper transfer belts 81 and the non-curved next recording sheet of paper Pa2 not directly sucked on the surfaces. The space between the recording sheet of paper Pa1 and the next recording sheet of paper Pa2 is particularly larger in the vicinity of the center of the recording sheet of paper Pa1. This is because the center curved surfaces 108 have a larger width and a larger height, and when the front surfaces of the paper transfer belts 81 are curved along such curved surfaces 108 and when the recording sheet of paper Pa1 are sucked onto such front surfaces of the paper transfer belts 81, the recording sheet of paper Pa1 forms a curved surface having a larger width and a larger height in the vicinity of the center of the recording sheet of paper Pa1.

In this state, when air is blown from the air exhaust holes 86*b* of the air exhaust duct 86 to part of the upper layers of the pile of paper that is on the front end surface of the pile of paper, the air quickly enters the space formed between the recording sheets of paper Pa1 and Pa2, thereby quickly separating the recording sheet of paper Pa2 from the recording sheet of paper Pa1. A particularly large amount of air enters the larger space formed between the vicinity of the center of the recording sheet of paper Pa1 and the next recording sheet of paper Pa2, thereby quickly separating the recording sheets of paper Pa1 and Pa2 starting at the respective centers. This effectively prevents overlapping feeding of the recording sheets of paper Pa1 and Pa2.

The paper transfer belts 81 are curved at three positions in accordance with the three curved surfaces 106 to 108, and accordingly, the uppermost recording sheet of paper Pa1 is curved at three positions. This leaves a plurality of areas of space between the recording sheet of paper Pa1 and the next recording sheet of paper Pa2, thereby reliably preventing overlapping feeding of the recording sheets of paper Pa1 and Pa2. Even when the recording sheet of paper comes in smaller size, the recording sheet of paper is curved at least along the single curved surface 107 to reliably form space between the recording sheet of paper and the next recording sheet of paper, thereby preventing overlapping feeding of the recording sheets of paper.

The paper transfer belts 81 and the recording sheet of paper Pa1 are curved in a similar manner to the manner in which the curved surfaces 106 to 108 are curved. This eliminates the possibility of gap between the paper transfer belts 81 and the recording sheet of paper Pa1. This, in turn, eliminates air intake into the gap from the vicinity of the distal end of the recording sheet of paper Pa1, and eliminates overlapping feeding of the recording sheets of paper that would be caused by air intake in the vicinity of the distal end of the recording sheet of paper Pa1.

The ribs 105*b* to 105*d* are disposed between the paper transfer belts 81, and the end surfaces of the ribs 105*a* to 105*e* and the front surfaces of the paper transfer belts 81 are aligned to form a smooth curved surface. This ensures sucking of the recording sheet of paper Pa1 in a more satisfactory manner. Additionally, providing the ribs 105*b* to 105*d* makes air intake difficult in the gap between the paper transfer belts 81 and the recording sheet of paper Pa1 from the vicinity of the distal end of the recording sheet of paper Pa1. This also prevents overlapping feeding of the recording sheets of paper that would be caused by air intake in the vicinity of the distal end of the recording sheet of paper Pa1.

Figure 13:
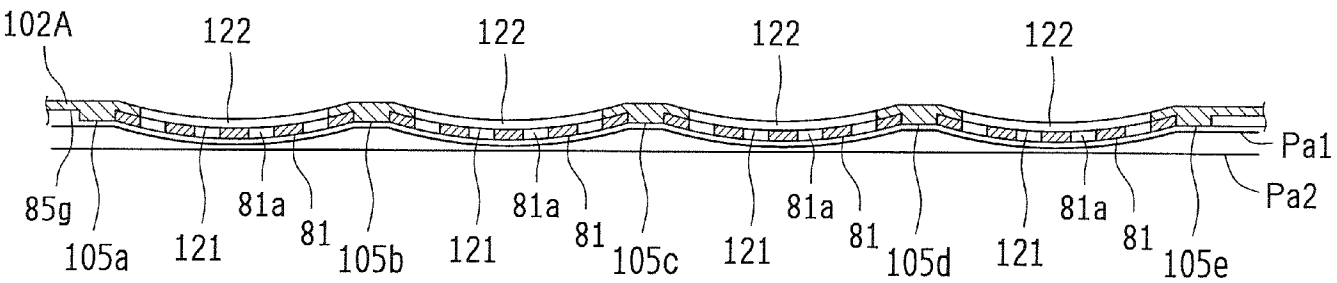
FIG. 13 is a cross-section, in a direction orthogonal to the pick-up direction of the recording sheet of paper, of the guide bottom plate of the air intake duct and the paper transfer belts according to a modification.

FIG. 13 is a cross-section, in a direction orthogonal to the pick-up direction E of the recording sheet of paper, of a guide bottom plate 102A of the air intake duct 85 and the paper transfer belts 81 according to a modification. In FIG. 13, the elements of similar operations to the operations of the elements shown in FIGS. 9 and 10 are designated similar reference numerals.

In an air intake duct 85A according to this modification, on the lower surface 85*g* of the guide bottom plate 102A, five ribs 105*a* to 105*e* extend in the pick-up direction E. The paper transfer belts 81 are held between the ribs 105*a* to 105*e*.

Between the ribs 105*a* to 105*e*, smooth curved surfaces 121 are formed with the lower surface 85*g* of the guide bottom plate 102A protruding downward. Specifically, between the ribs 105*a* to 105*e*, four curved surfaces 121 of the same shape and size are formed. The paper transfer belts 81 are deformed under pressure of the curved surfaces 121, and the front surfaces of the paper transfer belts 81 are curved along the curved surfaces 121.

On each of the curved surfaces 121, an air suction inlet 122 is formed, and the air suction inlet 122 is covered by a corresponding paper transfer belt 81. The air suction inlet 122 overlaps with the plurality of air holes 81*a* of the corresponding paper transfer belt 81.

The height of the ribs 105*a* to 105*e* is approximately equal to the thickness of the paper transfer belts 81. The end surfaces of the ribs 105*a* to 105*e* are flush with the front surfaces of the paper transfer belts 81. Thus, the end surfaces of the ribs 105*a* to 105*e* and the front surfaces of the paper transfer belts 81 are aligned to form a smooth curved surface.

In this modified configuration, when air is taken in through the air holes 81*a* of the paper transfer belts 81 and through the air suction inlets 122 of the air intake duct 85, the recording sheet of paper Pa1 is sucked onto the front surfaces of the paper transfer belts 81, making the recording sheet of paper Pa1 curved (waved) along the front surfaces of the paper transfer belts 81. This leaves space between the recording sheet of paper Pa1 curved by being directly sucked on the front surfaces of the paper transfer belts 81 and the non-curved next recording sheet of paper Pa2 not directly sucked on the surfaces, thereby separating the recording sheets of paper Pa1 and Pa2 from one another. Additionally, air is quickly blown between the recording sheets of paper from the air outlets 77*a* and 78*a* respectively of the assist ducts 77 and 78 and from the air exhaust holes 86*b* of the air exhaust duct 86, separating the recording sheet of paper Pa2 from the recording sheet of paper Pa1. This prevents overlapping feeding of the recording sheets of paper Pa1 and Pa2.

The paper transfer belts 81 are curved at four positions in accordance with the four curved surfaces 121, and accordingly, the recording sheet of paper Pa1 is curved at four positions. This leaves four areas of space between the recording sheet of paper Pa1 and the next recording sheet of paper Pa2, thereby reliably preventing overlapping feeding of the recording sheets of paper Pa1 and Pa2. Even when the recording sheet of paper comes in smaller size, the recording sheet of paper is curved at least along one curved surface 121 to reliably form space between the recording sheet of paper and the next recording sheet of paper, thereby preventing overlapping feeding of the recording sheets of paper.

The paper transfer belts 81 and the recording sheet of paper Pa1 are curved in a similar manner to the manner in which the curved surfaces 121 are curved. This eliminates the possibility of gap between the paper transfer belts 81 and the recording sheet of paper Pa1. This, in turn, eliminates air intake into the gap from the vicinity of the distal end of the recording sheet of paper Pa1, and eliminates overlapping feeding of the recording sheets of paper that would be caused by air intake in the vicinity of the distal end of the recording sheet of paper Pa1.

The ribs 105*b* to 105*d* are disposed between the paper transfer belts 81, and the end surfaces of the ribs 105*a* to 105*e* and the front surfaces of the paper transfer belts 81 are aligned to form a smooth curved surface. This ensures sucking of the recording sheet of paper Pa1 in a more satisfactory manner. Additionally, providing the ribs 105*b* to 105*d* makes air intake difficult in the gap between the paper transfer belts 81 and the recording sheet of paper Pa1 from the vicinity of the distal end of the recording sheet of paper Pa1. This also prevents overlapping feeding of the recording sheets of paper that would be caused by air intake in the vicinity of the distal end of the recording sheet of paper Pa1.

The centers of the curved surfaces 121 protrude downward (in the outer direction), and the paper transfer belts 81 in sliding contact with the curved surfaces 121 attempt to move closer to the centers of the curved surfaces 121, which makes the paper transfer belts 81 difficult to remove. Contrarily, when the centers of the curved surfaces 121 are depressed in the inner direction, the paper transfer belts 81 in sliding contact with the curved surfaces 121 attempt to move toward the ends of the curved surfaces 121, which makes the paper transfer belts 81 easier to remove.

While in the above-described embodiment the ribs 105*b* to 105*d* are disposed between the paper transfer belts 81, the ribs 105*b* to 105*d* may be eliminated to diminish the gaps between the paper transfer belts 81.

While the paper storage 74 is lifted upward and downward, it may be the paper transfer belts 81 that are lifted upward and downward or the paper storage 74 and the paper transfer belts 81 that are lifted upward and downward.

Embodiment 2

In embodiment 1, the curvature of each of the front surfaces of the paper transfer belts 81 is fixed. In feeders, however, as the recording sheet of paper to be transferred becomes thinner in thickness, the recording sheets of paper become highly adhesive with respect to each other, which can cause a tendency toward overlapping feeding of the recording sheets of paper. In view of this, in embodiment 2, the curvature of each of the front surfaces of the paper transfer belts 81 is adjustable so that as the recording sheet of paper becomes thinner in thickness, the curvature of each of the front surfaces of the paper transfer belts 81 increases, an example of which will be described here. In the feeder according to embodiment 2, a larger size of space is formed between the recording sheet of paper sucked on the front surfaces of the paper transfer belts 81 and the next recording sheet of paper. This is in an attempt to make the separativeness between the recording sheets of paper higher and to spread the recording sheets of paper in a satisfactory manner, thereby preventing overlapping feeding of the recording sheets of paper.

Also in embodiment 2, the amount of air intake from the air holes 81*a* of the paper transfer belts 81 is adjusted in accordance with the thickness of the recording sheets of paper so as to, irrespective of the thickness of the recording sheet of paper, suck and curve the recording sheet of paper on the front surfaces of the paper transfer belts 81 in a satisfactory manner. This reliably forms space between the recording sheet of paper sucked on the front surfaces of the paper transfer belts 81 and the next recording sheet of paper, thereby spreading the recording sheets of paper in a satisfactory manner.

The configuration of the image forming apparatus to which the feeder according to this embodiment is applied and an exemplary basic configuration of the feeder are similar to the exemplary configuration described in embodiment 1 by referring to FIGS. 1 to 7, and therefore will not be elaborated here.

Referring to FIGS. 14 to 20, differences from the feeder according to embodiment 1 will be described below. In FIGS. 14 to 20, the elements of similar operations to the operations of the elements of embodiment 1 are designated similar reference numerals.

Description will be made with regard to a configuration of the feeder according to this embodiment in which the front surfaces of the paper transfer belts 81 are curved in a direction orthogonal to the pick-up direction (paper transfer direction) E of the recording sheet of paper.

Figure 14:
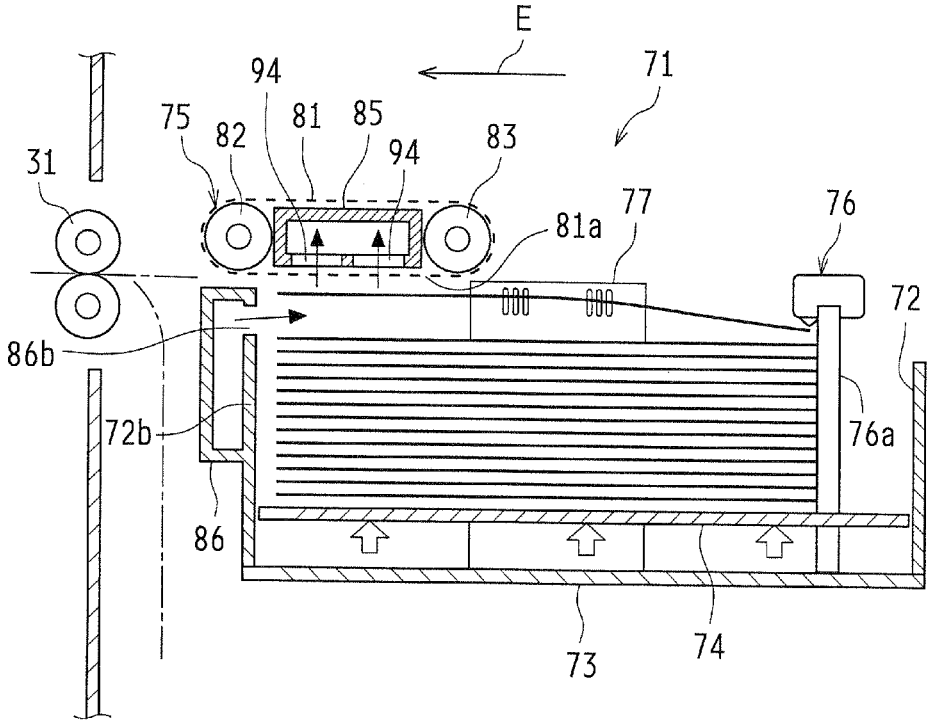
FIG. 14 is a schematic cross-section of the feeder.
Figure 15:
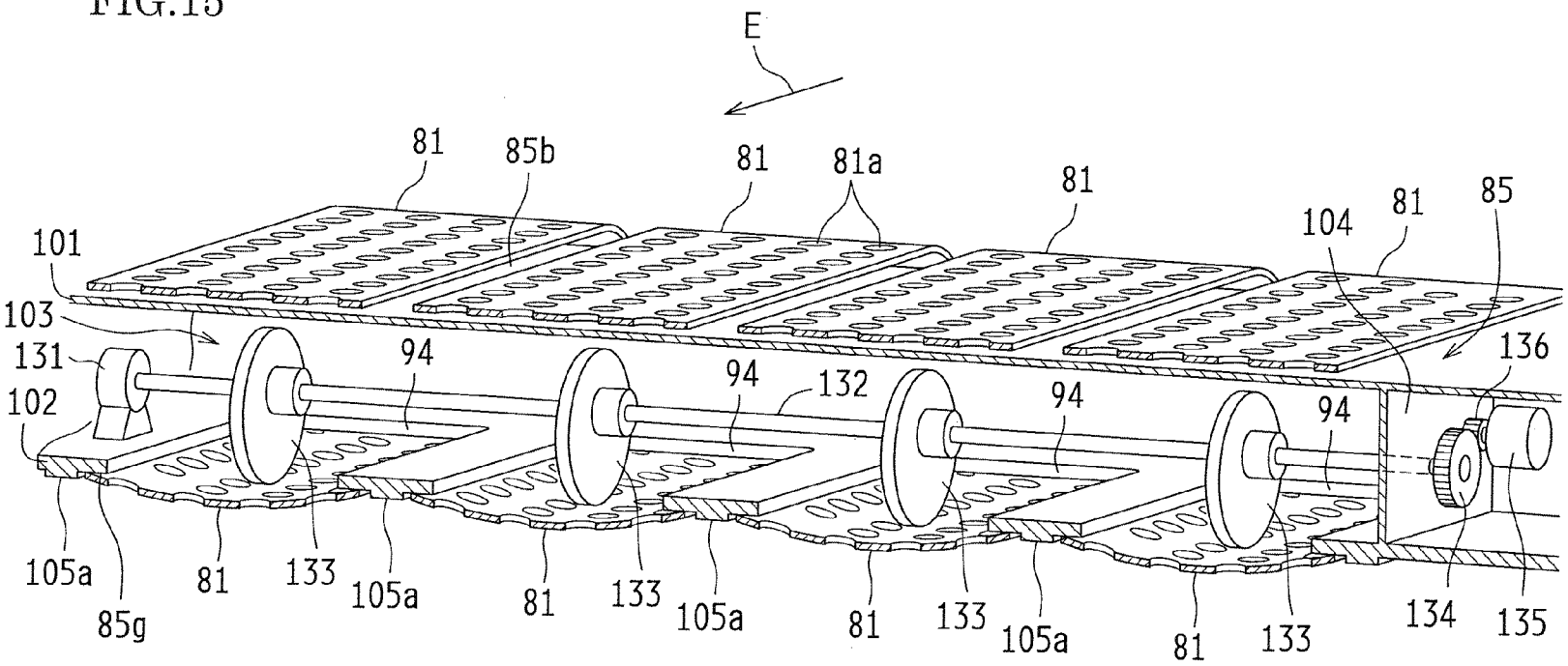
FIG. 15 is a perspective view of a cross-section, in a direction orthogonal to the pick-up direction of the recording sheet of paper, of the air intake duct and the paper transfer belts of the feeder.
Figure 16:
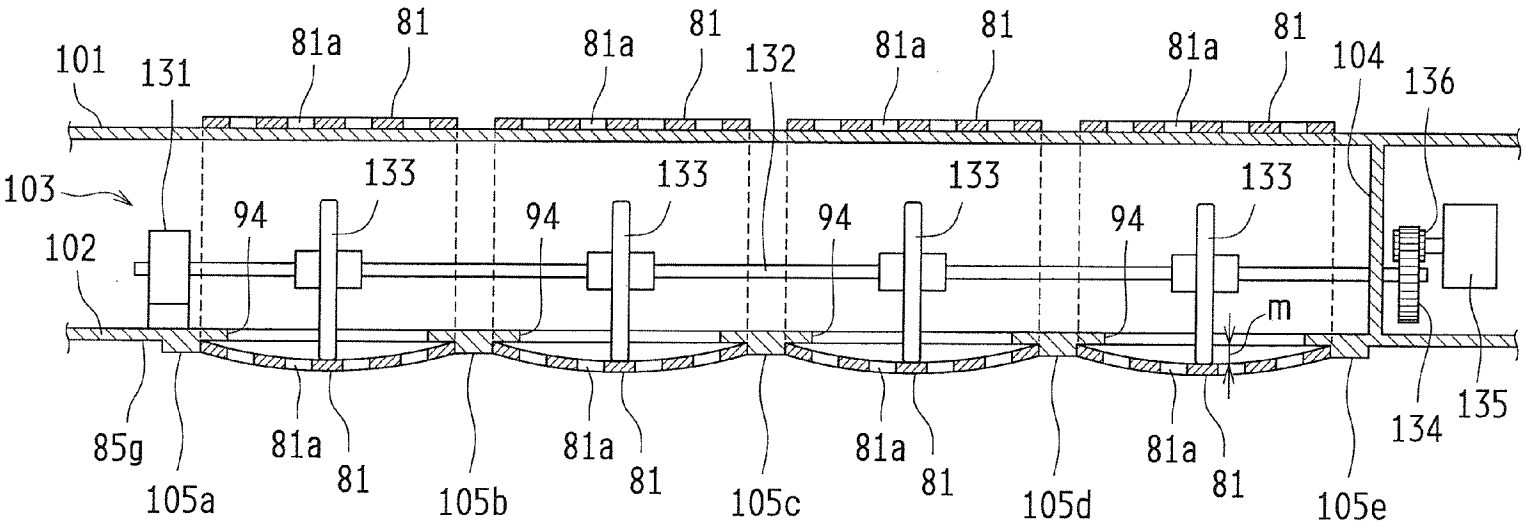
FIG. 16 is a cross-section of, in a direction orthogonal to the pick-up direction of the recording sheet of paper, the guide bottom plate of the air intake duct and the paper transfer belts.
Figure 17:
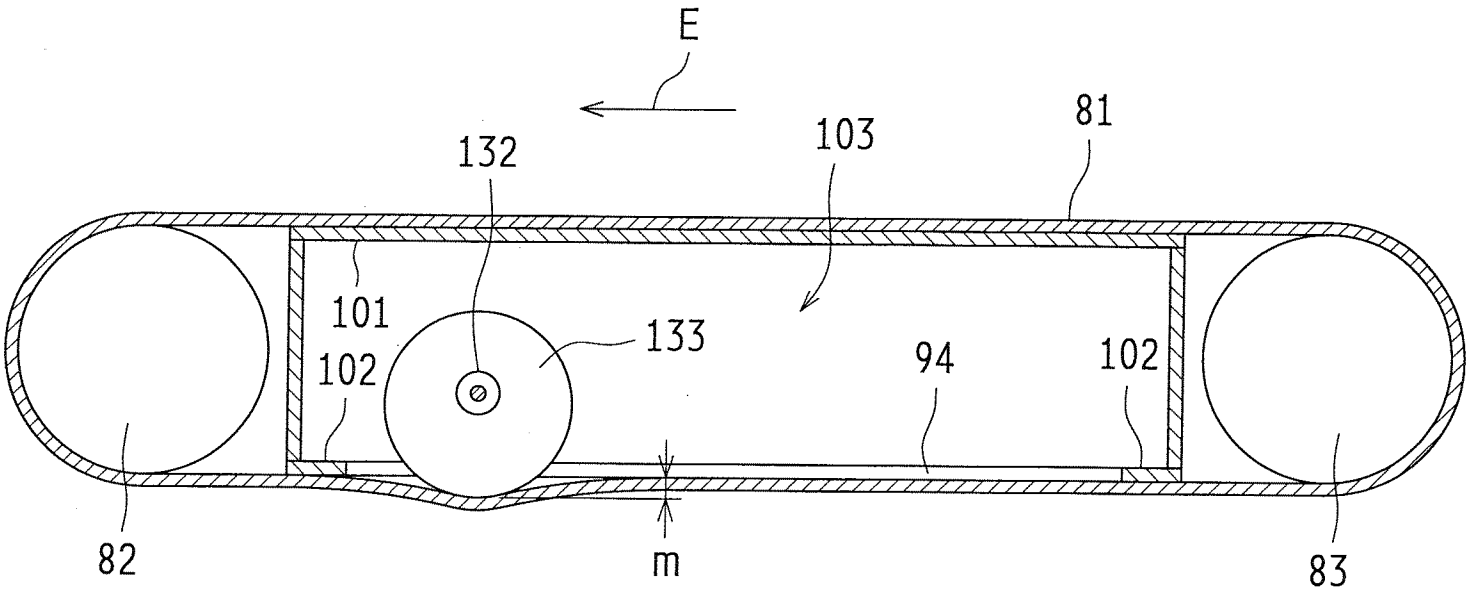
FIG. 17 is a longitudinal section, in the pick-up direction of the recording sheet of paper, of the air intake duct and the paper transfer belts.

FIG. 14 is a schematic cross-section of the feeder according to this embodiment. FIG. 15 is a perspective view of a cross-section, in a direction orthogonal to the pick-up direction E of the recording sheet of paper, of the air intake duct 85 and the paper transfer belts 81. FIG. 16 is a cross-section, in the same direction as in FIG. 15, of the air intake duct 85 and the paper transfer belts 81. FIG. 17 is a longitudinal section, in the pick-up direction E of the recording sheet of paper, of the air intake duct 85 and the paper transfer belts 81.

As shown in FIGS. 15 to 17, between the top plate 101 and the guide bottom plate 102 of the air intake duct 85, the air suction path 103 extends in a direction orthogonal to the pick-up direction E, and the air suction path 103 is sealed at its end by the partition wall 104. The upper surface 85*b* of the top plate 101 and the lower surface 85*g* of the guide bottom plate 102 are approximately planar.

On the lower surface 85*g* of the guide bottom plate 102, five ribs 105*a* to 105*e* extend in the pick-up direction E and protrude downward. Each of the intervals between the ribs 105*a* to 105*e* approximately corresponds to the width of each paper transfer belt 81. The paper transfer belts 81 are held between the ribs 105*a* to 105*e*. On the guide bottom plate 102, air suction inlets 94 are arranged in the direction orthogonal to the pick-up direction E, and the air suction inlets 94 are positioned between the ribs 105*a* to 105*e*. The paper transfer belts 81 cover the air suction inlets 94.

A bearing 131 is disposed in a protruding manner at a side portion of the guide bottom plate 102 further outward than the rib 105*a*. The bearing 131 and an axis hole (not shown) formed on the partition wall 104 rotatably support both ends of a rotation axis 132. Along the rotation axis 132, four eccentric cams 133 are arranged in the direction orthogonal to the pick-up direction E and secured on the rotation axis 132. The eccentric cams 133 are disposed at the respective air suction inlets 94 of the guide bottom plate 102. At one end of the rotation axis 132 and at the opposite side of the partition wall 104, a drive gear 134 is secured. The drive gear 134 meshes with a pinion gear 136 secured to the output shaft of a cam motor 135. The cam motor 135 rotates to turn the pinion gear 136 and the drive gear 134 into rotation, which turns the rotation axis 132 and the eccentric cams 133 into rotation.

In accordance with the rotation of the eccentric cams 133, a change occurs to a length m over which the circumference surface of each of the eccentric cams 133 protrudes from the respective air suction inlets 94 of the guide bottom plate 102. The rotation angle of the cam motor 135 is in a corresponding relationship with the length m over which the circumference surface of each of the eccentric cams 133 protrudes. Hence, controlling the rotation angle of the cam motor 135 ensures making changes to the length m over which the circumference surface of each of the eccentric cams 133 protrudes. The length m over which the circumference surface of each of the eccentric cams 133 protrudes is adjusted in the range of, for example, zero millimeter to several millimeters.

The eccentric cams 133 are set to be the same in diameter, amount of eccentricity, and direction of eccentricity. Hence, the lengths m over which the circumference surfaces of the eccentric cams 133 protrude are the same at any time irrespective of the rotation angles of the eccentric cams 133.

The paper transfer belts 81 have some elasticity, and when looped across the rollers 82 and 83, the paper transfer belts 81 are in contact with the planar lower surface 85*g* of the air intake duct 85 and the circumference surfaces of the eccentric cams 133.

Figure 18:
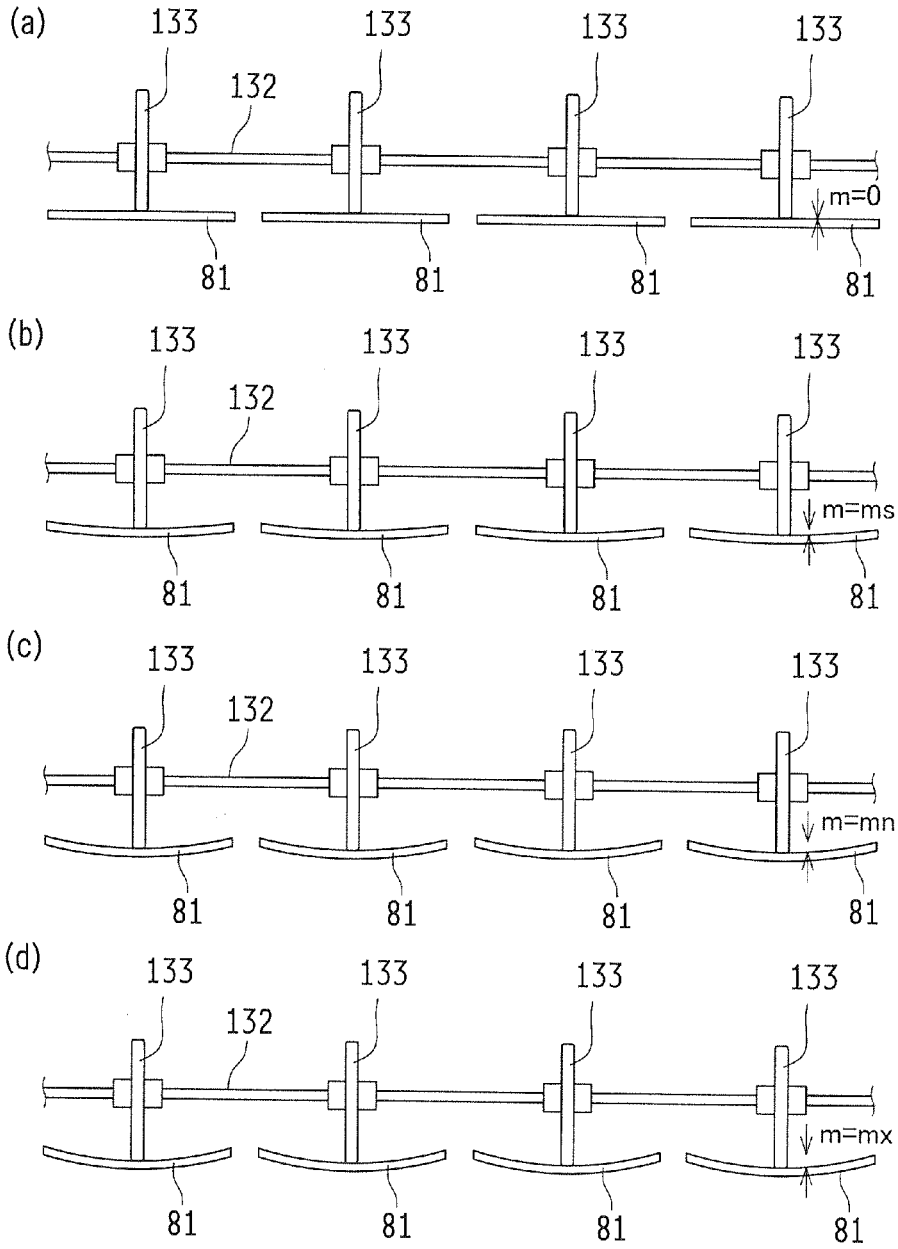
FIGS. 18(*a*) to 18(*d*) schematically show a relationship between the length over which the circumference surface of each of eccentric cams protrudes and the curvature of the front surface of each of the paper transfer belts.

As shown in FIG. 18(*a*), when the length m over which the circumference surface of each of the eccentric cams 133 protrudes is zero millimeter, the circumference surfaces of the eccentric cams 133 merely contact the rear surfaces of the paper transfer belts 81, and the front surfaces of the paper transfer belts 81 are kept planar. As shown in FIGS. 18(*b*), 18(*c*), and 18(*d*), when the length m over which the circumference surface of each of the eccentric cams 133 protrudes is longer than zero millimeter, the circumference surfaces of the eccentric cams 133 press the rear surfaces of the paper transfer belts 81 to curve the front surfaces of the paper transfer belts 81 in the direction orthogonal to the pick-up direction E. Thus, the curvature of each of the front surfaces of the paper transfer belts 81 is changed in accordance with the length m over which the circumference surface of each of the eccentric cams 133 protrudes. Of course, as the length m over which the circumference surface of each of the eccentric cams 133 protrudes increases, the curvature of each of the front surfaces of the paper transfer belts 81 increases.

Thus, the rotation angle of the cam motor 135 is controlled to change the length m over which the circumference surface of each of the eccentric cams 133 protrudes. This ensures making the front surfaces of the paper transfer belts 81 planar and adjusting the curvature of each of the front surfaces of the paper transfer belts 81.

When the front surfaces of the paper transfer belts 81 are in planar state, the recording sheet of paper sucked on the front surfaces of the paper transfer belts 81 is planar. When the front surfaces of the paper transfer belts 81 are in curved state, the recording sheet of paper sucked on the front surfaces of the paper transfer belts 81 is curved (waved). Here, the curvature of each of the front surfaces of the paper transfer belts 81 is approximately the same as the curvature of the recording sheet of paper.

As shown in FIG. 17, the eccentric cams 133 press a downstream side portion of each of the rear surfaces of the paper transfer belts 81 in the pick-up direction E. Thus, the downstream side portion of each of the front surfaces of the paper transfer belts 81 is curved by the eccentric cams 133.

Figure 19:
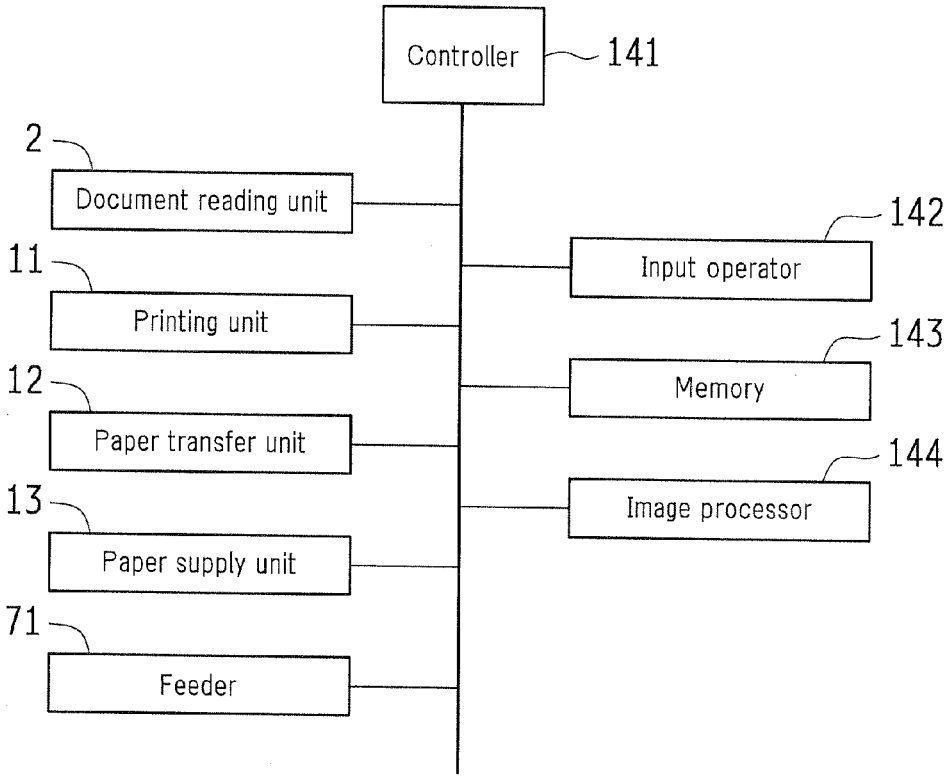
FIG. 19 is a block diagram illustrating a configuration of a control system of the image forming apparatus and the feeder.

Next, a configuration of the control system of the image forming apparatus 1 and the feeder 71 will be described. FIG. 19 is a block diagram illustrating a configuration of the control system. In FIG. 19, a controller 141 integrally controls the image forming apparatus 1, the feeder 71, and other elements, and includes a CPU, a RAM, a ROM, and various interfaces. An input operator 142 includes, for example, a plurality of operation keys, a liquid crystal display device, and a touch panel superimposed over the display of the liquid crystal display device. The input operator 142 displays an operation guidance of the image forming apparatus 1 or other information on the display of the liquid crystal display device, and outputs, to the controller 141, data or other information input and designated through handling of the operation keys or the like. A memory 143 is, for example, a hard disc device (HDD) and stores various data and programs. An image processor 144 subjects image data to various image processings.

In this configuration, the controller 141, for example, has the document reading unit 2 read the image on the document sheet of paper, has the memory 143 store image data indicating the image on the document sheet of paper, has the image processor 144 process the image data stored in the memory 143, and has the printing unit 11 record, on a recording sheet of paper, the image on the document sheet of paper indicated by the image data stored in the memory 143.

When through handling of the input operator 142 the paper supply unit 13 is selected and designated, the controller 141, in response, controls the paper supply unit 13 to feed a recording sheet of paper from the paper supply unit 13 to the printing unit 11, and has this recording sheet of paper record the image on the document.

Alternatively, when through handling of the input operator 142 the large capacity cassette 14 is selected and designated, the controller 141 controls the motor, fan, and other elements in the feeder 71 of the large capacity cassette 14 to feed a recording sheet of paper from the feeder 71 to the printing unit 11, and has this recording sheet of paper record the image on the document.

Further, it is possible to input, through handling of the input operator 142, any of the thicknesses of the recording sheets of paper accommodated in the large capacity cassette 14, and to store the thickness of the recording sheet of paper in the memory 143. For example, the input operator 142 displays "thin paper", "normal paper", and "thick paper", and any of "thin paper", "normal paper", and "thick paper" is selected through handling of the input operator 142 and stored in the memory 143. Any of "thin paper", "normal paper", and "thick paper" indicates the thickness of the recording sheet of paper. The thickness of the recording sheet of paper is used to adjust the curvature of each of the front surfaces of the paper transfer belts 81 and to adjust the amount of air intake from the air holes 81*a* of the paper transfer belts 81, as described later.

Next, the feeding operation of the feeder 71 will be described in detail. First, as shown in FIG. 14, a pile of paper is placed in the paper storage 74, and the position of the pile of paper is determined between the column 76*a* of the paper rear end guide 76 and the contact plate 72*b* of the outer frame 72, and the position of the pile of paper is also determined between the assist ducts 77 and 78.

When storing the pile of paper, a user handles the input operator 142 shown in FIG. 19 to input the thickness of the recording sheets of paper (any of "thin paper", "normal paper", and "thick paper") accommodated in the large capacity cassette 14, and stores the thickness of the recording sheets of paper in the memory 143.

The controller 141 reads the thickness of the recording sheets of paper from the memory 143, drivingly rotates the cam motor 135, controls the rotation angle of the cam motor 135, changes the length m over which the circumference surface of each of the eccentric cams 133 protrudes, and adjusts the curvature of each of the front surfaces of the paper transfer belts 81.

Here, when the memory 143 stores "thin paper" as the thickness of the recording sheets of paper accommodated in the large capacity cassette 14, the controller 141 sets the length m over which the circumference surface of each of the eccentric cams 133 protrudes at a largest length mx, and increases the curvature of each of the front surfaces of the paper transfer belts 81 (the state shown in FIG. 18(*d*)). When the memory 143 stores "normal paper" as the thickness of the recording sheets of paper, the controller 141 sets the length m over which the circumference surface of each of the eccentric cams 133 protrudes at a medium length mm, and sets the curvature of each of the front surfaces of the paper transfer belts 81 at a medium level (the state shown in FIG. 18(*c*)). When the memory 143 stores "thick paper" as the thickness of the recording sheets of paper, the controller 141 sets the length m over which the circumference surface of each of the eccentric cams 133 protrudes at a shortest length ms, and lowers the curvature of each of the front surfaces of the paper transfer belts 81 (the state shown in FIG. 18(*b*)). These lengths are in the relationship: zero millimeter<length ms<length mm<length mx.

In this manner, the controller 141 adjusts and sets the curvature of each of the front surfaces of the paper transfer belts 81 in accordance with the thickness of the recording sheets of paper accommodated in the large capacity cassette 14. Then, the controller 141 drivingly rotates the pulse motor 92 of the feeder 71 to have the pulse motor 92 turn the winder pulleys 98 into clockwise rotation, lifts the paper storage 74 upward, and determines the position of the uppermost recording sheet of paper among the pile of paper at a predetermined height. For example, the controller 141 drivingly rotates the pulse motor 92 to lift the paper storage 74 upward until a sensor (not shown) disposed at a head portion 76*b* of the paper rear end guide 76 detects the uppermost recording sheet of paper among the pile of paper.

The controller 141 also drivingly rotates the assist fans 79 and 80 of the feeder 71 to forward air from the assist fans 79 and 80 to the assist ducts 77 and 78, and blows the air from the air outlets 77*a* and 78*a* respectively of the assist ducts 77 and 78 to part of the pile of paper on the paper storage 74 that is near the front end of the pile of paper and that is on both lateral side surfaces of the pile of paper. Thus, the air enters between the recordings sheets of paper, thereby spreading the recording sheets of paper.

The controller 141 also drivingly rotates the air intake-exhaust fan 84 of the feeder 71 to forward air from the air intake-exhaust fan 84 to the air exhaust duct 86, and blows the air from the air exhaust holes 86*b* of the air exhaust duct 86 to the front end surface of the pile of paper. Thus, the air enters between the recordings sheet of paper, thereby spreading the recording sheets of paper. Then, the controller 141 has air taken in from the air intake duct 85 to the air intake-exhaust fan 84 and through the air holes 81*a* of the paper transfer belts 81 and the air suction inlets 94 on the lower surface 85*g* of the air intake duct 85. At the same time, the controller 141 rotates the rollers 82 and 83 to turn the paper transfer belts 81 into circumferential movement, has the recording sheet of paper sucked onto the front surfaces of the paper transfer belts 81, and has the paper transfer belts 81 pick up the recording sheet of paper in the pick-up direction E and transfer the recording sheet of paper.

Here, the controller 141 controls the number of rotations of the air intake-exhaust fan 84 in accordance with the thickness of the recording sheets of paper to adjust and set the amount of air intake (and the amount of air exhaust) by the air intake-exhaust fan 84. For example, when the memory 143 stores "thin paper" as the thickness of the recording sheets of paper, the controller 141 sets the amount of air intake by the air intake-exhaust fan 84 at a low level. The thin recording sheet of paper is light-weight and flexible. Thus, even when the amount of air intake from the air holes 81*a* of the paper transfer belts 81 is set at a low level, the recording sheet of paper is sucked onto the front surfaces of the paper transfer belts 81 in a satisfactory manner, and the recording sheet of paper is curved sufficiently along the front surfaces of the paper transfer belts 81.

When the recording sheets of paper are "thin paper", the controller 141 sets the length m over which the circumference surface of each of the eccentric cams 133 protrudes at the largest length mx to increase the curvature of each of the front surfaces of the paper transfer belts 81 (the state shown in FIG. 18(*d*)). This enlarges the space between the recording sheet of paper sucked on the front surfaces of the paper transfer belts 81 and the next recording sheet of paper. Thus, even when the recording sheets of paper are "thin paper" and the recording sheets of paper are highly adhesive with respect to each other, the recording sheets of paper separate from each other in a satisfactory manner and spread.

When the memory 143 stores "normal paper" as the thickness of the recording sheets of paper, the controller 141 sets the amount of air intake by the air intake-exhaust fan 84 at a medium level. The normal recording sheet of paper is medium both in weight and rigidity. Thus, setting the amount of air intake from the air holes 81*a* of the paper transfer belts 81 at a medium level makes the recording sheet of paper sucked and curved on the front surfaces of the paper transfer belts 81.

When the recording sheets of paper are "normal paper", the controller 141 sets the length m over which the circumference surface of each of the eccentric cams 133 protrudes at the medium length mm to set the curvature of each of the front surfaces of the paper transfer belts 81 at a medium level (the state shown in FIG. 18(*c*)). This makes the space medium between the recording sheet of paper sucked on the front surfaces of the paper transfer belts 81 and the next recording sheet of paper, and the recording sheets of paper separate from each other in a satisfactory manner and spread.

When the memory 143 stores "thick paper" as the thickness of the recording sheets of paper, the controller 141 sets the amount of air intake by the air intake-exhaust fan 84 at a high level. The thick recording sheet of paper is high in weight and rigidity. Thus, it is necessary to set the amount of air intake from the air holes 81*a* of the paper transfer belts 81 at a high level so as to make the recording sheet of paper reliably sucked and curved on the front surfaces of the paper transfer belts 81.

When the recording sheets of paper are "thick paper", the controller 141 sets the length m over which the circumference surface of each of the eccentric cams 133 protrudes at the shortest length ms to reduce the curvature of each of the front surfaces of the paper transfer belts 81 (the state shown in FIG. 18(*b*)). This diminishes the space between the recording sheet of paper sucked on the front surfaces of the paper transfer belts 81 and the next recording sheet of paper. However, since the recording sheets of paper are "thick paper" and are less adhesive with respect to each other, the recording sheets of paper separate from each other in a satisfactory manner and spread.

Figure 20:
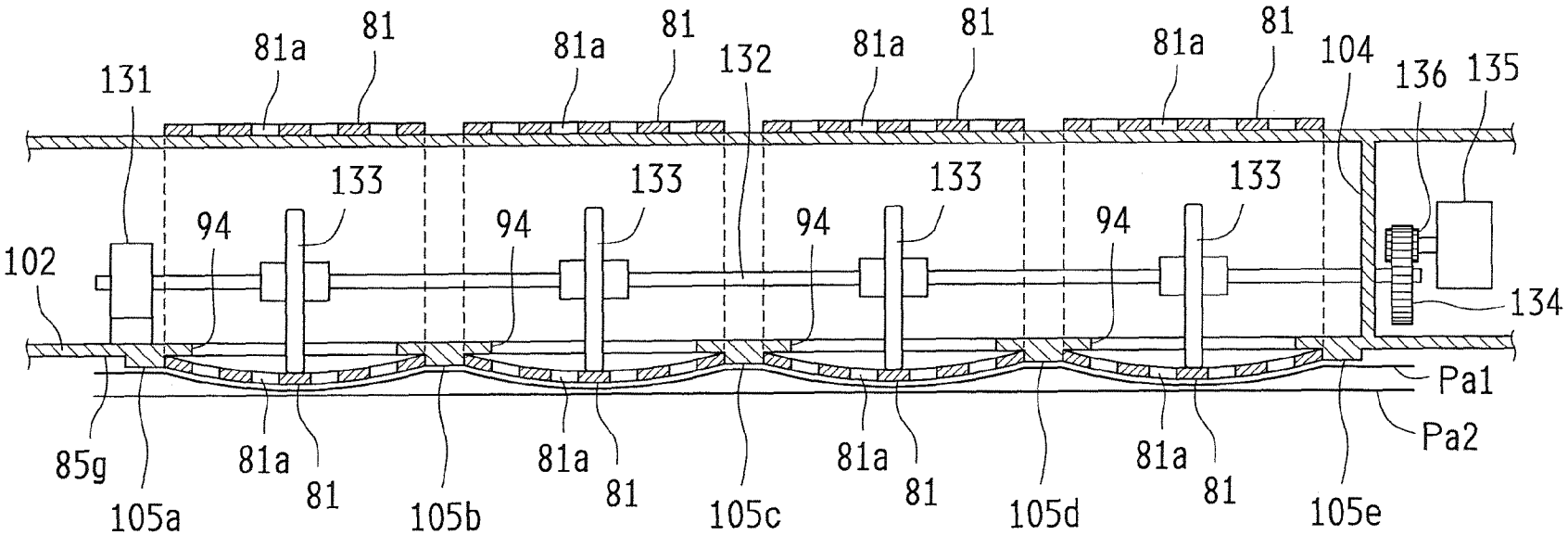
FIG. 20 is a cross-section of the uppermost recording sheet of paper curved by being sucked directly on the front surfaces of the paper transfer belts and a non-curved next recording sheet of paper not directly sucked on the surfaces.

FIG. 20 is a cross-section of the space between the recording sheet of paper sucked on the front surfaces of the paper transfer belts 81 and the next recording sheet of paper. As shown in FIG. 20, even when the plurality of overlapping recording sheets of paper Pa1 and Pa2 are attracted to the front surfaces of the paper transfer belts 81, space is left between the uppermost recording sheet of paper Pa1 curved by being directly sucked on the front surfaces of the paper transfer belts 81 and the planar next recording sheet of paper Pa2 not directly sucked on the surfaces. Thus, the recording sheets of paper Pa1 and Pa2 separate from one another.

Air from the air outlets 77*a* and 78*a* respectively of the assist ducts 77 and 78 and the air exhaust holes 86*b* of the air exhaust duct 86 is quickly blown between the recording sheets of paper Pa1 and Pa2, thereby reliably separating the recording sheet of paper Pa2 from the recording sheet of paper Pa1. This effectively prevents overlapping feeding of the recording sheets of paper Pa1 and Pa2.

The uppermost recording sheet of paper Pa1 is curved at four positions along the curved surfaces of the paper transfer belts 81, leaving four areas of space between the recording sheet of paper Pa1 and the next recording sheet of paper Pa2.

This reliably prevents overlapping feeding of the recording sheets of paper Pa1 and Pa2. Even when the recording sheets of paper Pa1 and Pa2 come in smaller size, the recording sheet of paper Pa1 is curved at least along one curved surface to reliably form space between the recording sheet of paper Pa1 and the next recording sheet of paper Pa2, thereby preventing overlapping feeding of the recording sheets of paper Pa1 and Pa2.

The recording sheet of paper sucked on the front surfaces of the paper transfer belts 81 is separated from the next recording sheet of paper and transferred at a downstream side portion of each of the front surfaces of the paper transfer belts 81. As shown in FIG. 17, the eccentric cam 133 curves a downstream side portion of the front surface of the paper transfer belt 81. This makes the recording sheets of paper spread in a satisfactory manner at this downstream side portion, thereby effectively preventing overlapping feeding of the recording sheets of paper.

Thus, the feeder 71 according to this embodiment changes the curvature of each of the front surfaces of the paper transfer belts 81 in accordance with the thickness of the recording sheets of paper, and at the same time adjusts the amount of air intake by the air intake-exhaust fan 84 in accordance with the thickness of the recording sheets of paper. This makes the recording sheet of paper sucked onto the front surfaces of the paper transfer belts 81 in a satisfactory manner irrespective of the thickness of the recording sheet of paper, makes the recording sheet of paper curved in an appropriate manner, leaves space between the recording sheet of paper and the next recording sheet of paper to spread the recording sheets of paper in a satisfactory manner, and prevents overlapping feeding of the recording sheets of paper.

In this embodiment, the curvature of each of the front surfaces of the paper transfer belts 81 and the amount of air intake by the air intake-exhaust fan 84 are changed in accordance with the thickness of the recording sheets of paper. The curvature of each of the front surfaces of the paper transfer belts 81 and the amount of air intake by the air intake-exhaust fan 84 may be changed in accordance with the rigidity or basis weight of the recording sheet of paper. This case provides similar advantageous effects. This is because the thickness, rigidity, and basis weight of the recording sheets of paper are in a mutually corresponding relationship. For example, as the recording sheet of paper becomes thinner in thickness, its rigidity and basis weight tend to become smaller, while as the recording sheet of paper becomes larger in thickness, its rigidity and basis weight tend to become larger.

As examples of the thickness of the recording sheets of paper, "thin paper", "normal paper", and "thick paper" have been illustrated. It is also possible to classify the thickness of the recording sheets of paper into two, four, or more than four kinds. It is also possible to first set "thin paper", "normal paper", and "thick paper" while allowing for minor adjustments of thickness to be made by manual operation, and to make minor adjustments of the curvature of each of the front surfaces of the paper transfer belts 81.

It is also possible to use a sensor to detect the moisture content of the recording sheets of paper and to change the curvature of each of the front surfaces of the paper transfer belts 81 in accordance with the moisture content. This is because as the moisture content of the recording sheets of paper increases, the recording sheets of paper tend to bend like thin paper, and the recording sheets of paper become more adhesive with respect to each other. This necessitates making the separativeness between the recording sheets of paper higher by enlarging the space between the recording sheet of paper sucked on the front surfaces of the paper transfer belts 81 and the next recording sheet of paper. As the moisture content of the recording sheets of paper becomes smaller, the recording sheets of paper become, like thick paper, difficult to curve, and the recording sheets of paper become less adhesive with respect to each other. Thus, the recording sheets of paper separate from each other without enlarging the space between the recording sheet of paper sucked on the front surfaces of the paper transfer belts 81 and the next recording sheet of paper.

It is also possible to use a sensor to detect the amount of charging (the amount of static charging) of the recording sheets of paper, and to change the curvature of each of the front surfaces of the paper transfer belts 81 in accordance with the amount of charging. This is because as the amount of charging of the recording sheets of paper increases, the recording sheets of paper become more adhesive with respect to each other. This necessitates enlarging the space between the recording sheet of paper sucked on the front surfaces of the paper transfer belts 81 and the next recording sheet of paper. As the amount of charging of the recording sheets of paper becomes smaller, the recording sheets of paper become less adhesive with respect to each other. This eliminates the need for enlarging the space between the recording sheet of paper and the next recording sheet of paper.

The lengths m over which the circumference surfaces of the eccentric cams 133 protrude are made the same at any time irrespective of the rotation angle of the eccentric cams 133 so as to make the curvatures of the front surfaces of the paper transfer belts 81 the same. It is also possible to adjust the curvature of each of the front surfaces of the paper transfer belts 81 independently by varying the shape of each of the eccentric cams 133 or differentiating the phase of each of the eccentric cams 133.

The eccentric cams 133 press the rear surfaces of the paper transfer belts 81 to curve the front surfaces of the paper transfer belts 81. It is also possible to use some other pressing member to press the rear surfaces of the paper transfer belts 81. For example, a screw or the like may be used to press the rear surfaces of the paper transfer belts 81. It is also possible to displace the eccentric cams and the pressing members by manual control (operation) in accordance with, for example, the thickness of the recording sheets of paper.

The present invention can be embodied and practiced in other different forms without departing from the spirit and essential characteristics of the present invention. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A feeder comprising a paper storage configured to store a pile of paper, the feeder being configured to take in air through an air hole of a paper transfer member so as to suck a sheet of paper among the pile of paper onto a front surface of the paper transfer member and so as to transfer the sheet of paper, the feeder comprising:

a guide portion configured to guide the paper transfer member, the guide portion comprising a curved portion that is curved only along a direction that extends orthogonal to a transfer direction of the sheet of paper, the curved portion being in sliding contact with a rear surface of the paper transfer member opposite the front surface of the paper transfer member.

2. The feeder according to claim 1, wherein the paper transfer member comprises a plurality of paper transfer members arranged in parallel to each other in a direction orthogonal to the transfer direction of the sheet of paper, and wherein the curved portion comprises a plurality of curved portions arranged in a direction orthogonal to the transfer direction of the sheet of paper.

3. The feeder according to claim 2, wherein an arrangement interval between the curved portions is larger than an arrangement interval between the paper transfer members.

4. The feeder according to claim 2, wherein the curved portions each comprise a width in the direction orthogonal to the transfer direction of the sheet of paper, the width being larger in a vicinity of a center of the sheet of paper than in a vicinity of lateral sides of the sheet of paper.

5. The feeder according to claim 4, wherein the paper transfer member comprises a plurality of paper transfer members in sliding contact with a part of the curved portion comprising the larger width.

6. The feeder according to claim 2, wherein the curved portions each comprise a height from a valley portion to an apex portion, the height being smaller in a vicinity of lateral sides of the sheet of paper than in a vicinity of a center of the sheet of paper.

7. The feeder according to claim 2, wherein the guide portion comprises a rib located between the paper transfer members, the rib protruding from a gap between the paper transfer members to be flush with a surface of each of the paper transfer members.

8. An image forming apparatus comprising the feeder according to claim 1.

9. The feeder according to claim 1, wherein the curved portion includes an air suction inlet overlapping and communicating with a plurality of the air holes of the paper transfer member.

10. The feeder according to claim 9, further comprising an air suction path disposed in a direction orthogonal to the transfer direction of the sheet of paper so as to take in air through the air suction inlet.

11. The feeder according to claim 1, further comprising an air spray spraying air into onto a front end surface of the pile of paper.

12. A feeder comprising a paper storage configured to store a pile of paper, the feeder being configured to take in air through an air hole of a paper transfer member so as to suck a sheet of paper among the pile of paper onto a front surface of the paper transfer member and so as to transfer the sheet of paper, the feeder comprising:

a guide portion configured to guide the paper transfer member, the guide portion comprising a curved portion that is curved along a direction that extends orthogonal to a transfer direction of the sheet of paper, the curved portion being in sliding contact with a rear surface of the paper transfer member opposite the front surface of the paper transfer member, the guide portion including at least one convex curved portion that protrudes outward toward the rear surface of the paper transfer member that is in sliding contact with the guide portion.

13. The feeder according to claim 12, wherein the paper transfer member comprises a plurality of paper transfer members arranged in parallel to each other in a direction orthogonal to the transfer direction of the sheet of paper, and wherein the curved portion comprises a plurality of curved portions arranged in a direction orthogonal to the transfer direction of the sheet of paper.

14. The feeder according to claim 13, wherein an arrangement interval between the curved portions is larger than an arrangement interval between the paper transfer members.

15. The feeder according to claim 13, wherein the curved portions each comprise a width in the direction orthogonal to the transfer direction of the sheet of paper, the width being larger in a vicinity of a center of the sheet of paper than in a vicinity of lateral sides of the sheet of paper.

16. The feeder according to claim 15, wherein the paper transfer member comprises a plurality of paper transfer members in sliding contact with a part of the curved portion comprising the larger width.

17. The feeder according to claim 13, wherein the curved portions each comprise a height from a valley portion to an apex portion, the height being smaller in a vicinity of lateral sides of the sheet of paper than in a vicinity of a center of the sheet of paper.

18. The feeder according to claim 13, wherein the guide portion comprises a rib located between the paper transfer members, the rib protruding from a gap between the paper transfer members to be flush with a surface of each of the paper transfer members.

19. An image forming apparatus comprising the feeder according to claim 12.

20. The feeder according to claim 12, wherein the curved portion includes an air suction inlet overlapping and communicating with a plurality of the air holes of the paper transfer member.

21. The feeder according to claim 20, further comprising an air suction path disposed in a direction orthogonal to the transfer direction of the sheet of paper so as to take in air through the air suction inlet.

22. The feeder according to claim 12, further comprising an air spray spraying air into onto a front end surface of the pile of paper.

* * * * *